US012624472B2

(12) United States Patent
Tomita et al.

(10) Patent No.: US 12,624,472 B2
(45) Date of Patent: May 12, 2026

(54) PLATING APPARATUS

(71) Applicant: EBARA CORPORATION, Tokyo (JP)

(72) Inventors: Masaki Tomita, Tokyo (JP); Kentaro Yamamoto, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 558 days.

(21) Appl. No.: 18/017,613

(22) PCT Filed: Jun. 17, 2022

(86) PCT No.: PCT/JP2022/024316
§ 371 (c)(1),
(2) Date: Jan. 23, 2023

(87) PCT Pub. No.: WO2023/243079
PCT Pub. Date: Dec. 21, 2023

(65) Prior Publication Data

US 2024/0271313 A1 Aug. 15, 2024

(51) Int. Cl.

| | |
|---|---|
| ***C25D 21/08*** | (2006.01) |
| ***C25D 17/02*** | (2006.01) |
| ***C25D 17/06*** | (2006.01) |
| ***C25D 21/12*** | (2006.01) |

(52) U.S. Cl.
CPC ..... *C25D 21/08* (2013.01); *C25D 17/02* (2013.01); *C25D 17/06* (2013.01); *C25D 21/12* (2013.01)

(58) Field of Classification Search
None
See application file for complete search history.

(56) References Cited

U.S. PATENT DOCUMENTS

| | | | | |
|---|---|---|---|---|
| 9,812,344 | B2 * | 11/2017 | Rye | H01L 21/68721 |
| 2013/0061875 | A1 * | 3/2013 | Woodruff | C25D 17/004 134/6 |
| 2022/0396897 | A1 | 12/2022 | Chang et al. | |

FOREIGN PATENT DOCUMENTS

| | | | |
|---|---|---|---|
| CN | 112779579 | A | 5/2021 |
| JP | 2006-114884 | A | 4/2006 |
| JP | 6934127 | B1 | 9/2021 |
| JP | 7047200 | B1 | 4/2022 |

OTHER PUBLICATIONS

English translation CN 214655317 (Year: 2021).*

* cited by examiner

*Primary Examiner* — Stefanie S Wittenberg
(74) *Attorney, Agent, or Firm* — BakerHostetler

(57) ABSTRACT

Provided is a plating apparatus that allows cleaning a contact cleaning member.
The plating apparatus includes: a plating tank configured to house a plating solution; a substrate holder configured to hold a substrate with a surface to be plated facing downward, the substrate holder including a contact member for feeding power to the substrate; a contact cleaning member 482 for discharging a cleaning liquid to the contact member while the contact cleaning member is at a cleaning position between the plating tank and the substrate holder; a driving mechanism 476 configured to move the contact cleaning member 482 between the cleaning position and a retracted position retracted from between the plating tank and the substrate holder; and a nozzle cleaning cover 489 configured to cover an upper portion of the contact cleaning member 482 while the contact cleaning member 482 is at the retracted position.

8 Claims, 17 Drawing Sheets

1000

PLATING APPARATUS

CROSS-REFERENCE TO RELATED APPLICATIONS

This application is a U.S. national phase application of International Patent Application No. PCT/JP2022/024316 filed Jun. 17, 2022, which is incorporated by reference in its entirety for any and all purposes.

TECHNICAL FIELD

This application relates to a plating apparatus.

BACKGROUND ART

There has been known a cup type electroplating apparatus as one example of a plating apparatus. The cup type electroplating apparatus deposits a conductive film on a surface of a substrate (for example, a semiconductor wafer) by immersing the substrate held by a substrate holder with a surface to be plated facing downward in a plating solution and applying a voltage between the substrate and an anode.

A plating apparatus disclosed in PTL 1 includes a cleaning device including a substrate cleaning member and a contact cleaning member. This plating apparatus is configured to discharge a cleaning liquid from the substrate cleaning member to a substrate after a plating process to clean a plating solution attached to the substrate. Additionally, this plating apparatus is configured to discharge the cleaning liquid from the contact cleaning member to a contact member of a substrate holder after the substrate is cleaned to clean the plating solution that has entered an arranged region of the contact member.

CITATION LIST

Patent Literature

PTL 1: Japanese Patent No. 7047200

SUMMARY OF INVENTION

Technical Problem

However, in the prior art, attachment of the cleaning liquid containing the plating solution to the contact cleaning member when substrate cleaning is performed is not considered. That is, there may be a case where when the cleaning liquid discharged from the substrate cleaning member collides with the substrate, the cleaning liquid containing the plating solution attached to the substrate drops from the substrate and attaches to the contact cleaning member. When the subsequent cleaning of the contact member is performed while the plating solution attaches to the contact cleaning member, the cleaning liquid containing the plating solution possibly enters an arranged region of the contact member and therefore is not preferred. Additionally, the plating solution enters the arranged region of the contact member from a gap of a sealing member of the substrate holder during a plating process in some cases. In contrast to this, it is considered that presence or absence of a leakage of the plating solution is determined based on a conductivity of the cleaning liquid after cleaning the contact member, but when the plating solution attaches to the contact cleaning member, it possibly adversely affects the leakage determination.

Therefore, one object of this application is to provide a plating apparatus that allows cleaning a contact cleaning member.

Solution to Problem

According to one embodiment, there is disclosed a plating apparatus that includes a plating tank, a substrate holder, a contact cleaning member, a driving mechanism, and a nozzle cleaning cover. The plating tank is configured to house a plating solution. The substrate holder is configured to hold a substrate with a surface to be plated facing downward. The substrate holder includes a contact member for feeding power to the substrate. The contact cleaning member is for discharging a cleaning liquid to the contact member while the contact cleaning member is at a cleaning position between the plating tank and the substrate holder. The driving mechanism is configured to move the contact cleaning member between the cleaning position and a retracted position retracted from between the plating tank and the substrate holder. The nozzle cleaning cover is configured to cover an upper portion of the contact cleaning member while the contact cleaning member is at the retracted position.

DESCRIPTION OF EMBODIMENTS

Figure 1:
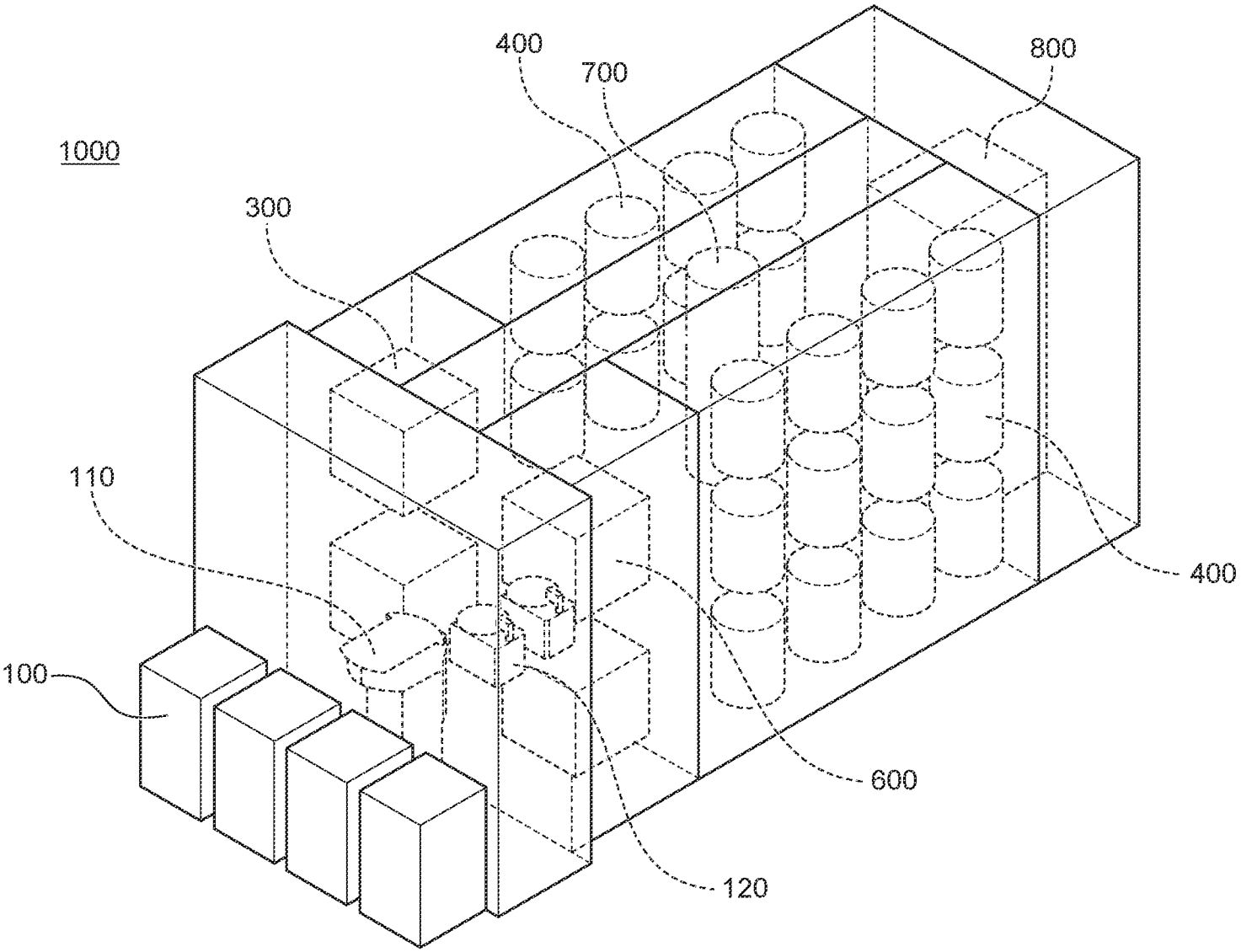
FIG. 1 is a perspective view illustrating an overall configuration of a plating apparatus according to this embodiment.

Hereinafter, referring to the accompanying drawings, embodiments of the present invention will be described. In the drawings described later, identical reference numerals are assigned for identical or equivalent constituent elements, and therefore such elements will not be further elaborated.

<Overall Configuration of Plating Apparatus>

Figure 2:
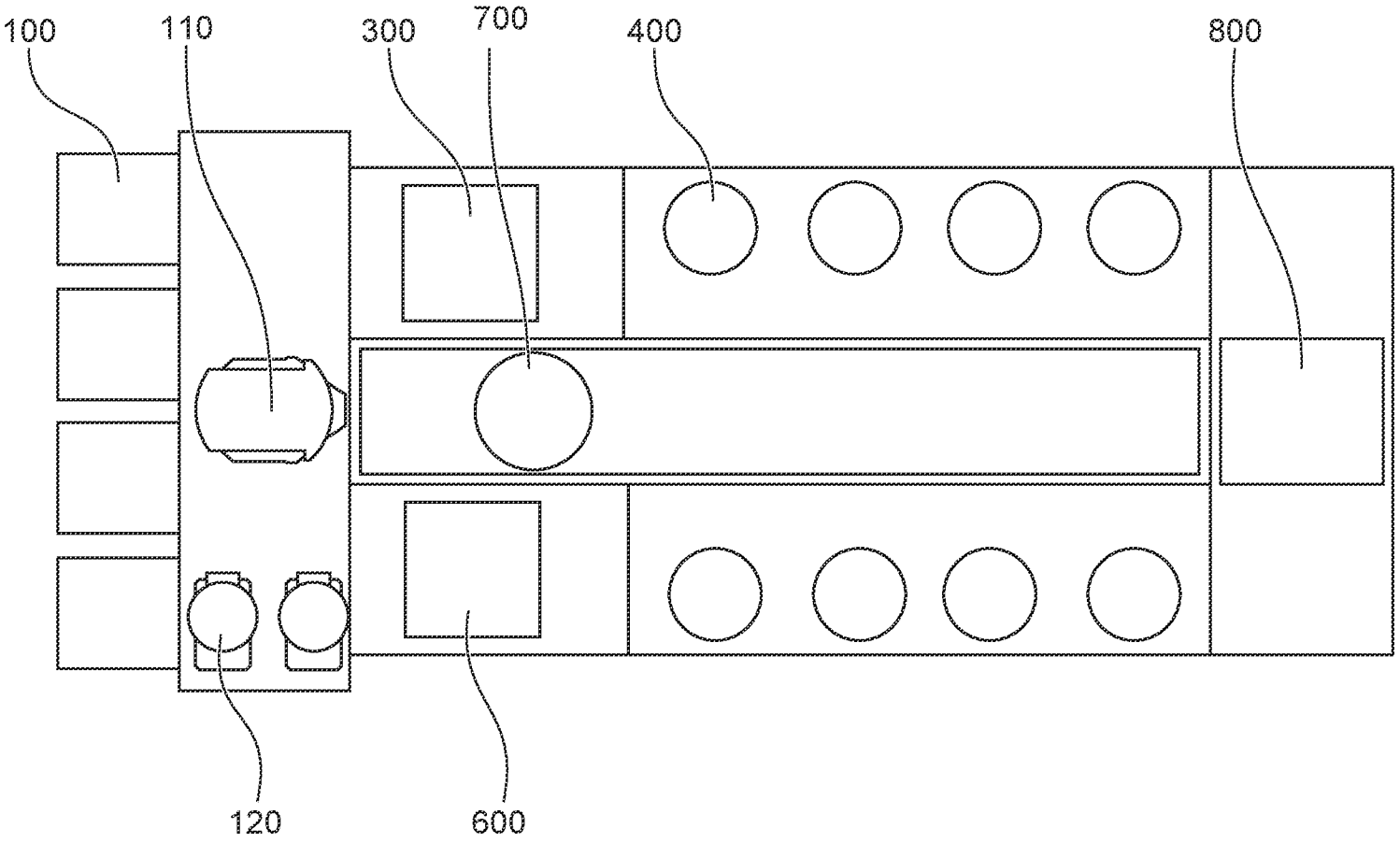
FIG. 2 is a plan view illustrating the overall configuration of the plating apparatus according to this embodiment.

FIG. 1 is a perspective view illustrating the overall configuration of the plating apparatus of this embodiment. FIG. 2 is a plan view illustrating the overall configuration of the plating apparatus of this embodiment. As illustrated in FIG. 1 and FIG. 2, a plating apparatus 1000 includes load ports 100, a transfer robot 110, aligners 120, pre-soak modules 300, plating modules 400, spin rinse dryers 600, a transfer device 700, and a control module 800.

The load port 100 is a module for loading a substrate housed in a cassette, such as a FOUP, (not illustrated) to the plating apparatus 1000 and unloading the substrate from the plating apparatus 1000 to the cassette. While the four load ports 100 are disposed to be arranged in the horizontal direction in this embodiment, the number of load ports 100 and arrangement of the load ports 100 are arbitrary. The transfer robot 110 is a robot for transferring the substrate that is configured to grip or release the substrate between the load port 100, the aligner 120, and the spin rinse dryer 600. The transfer robot 110 and the transfer device 700 can perform delivery and receipt of the substrate via a temporary placement table (not illustrated) to grip or release the substrate between the transfer robot 110 and the transfer device 700.

The aligner 120 is a module for adjusting a position of an orientation flat, a notch, and the like of the substrate in a predetermined direction. While the two aligners 120 are disposed to be arranged in the horizontal direction in this embodiment, the number of aligners 120 and arrangement of the aligners 120 are arbitrary.

For example, the pre-soak module 300 is configured to remove an oxidized film having a large electrical resistance present on a surface of a seed layer and the like formed on a surface to be plated of the substrate before a plating process by etching with a process liquid, such as sulfuric acid and hydrochloric acid, and perform a pre-soak process that cleans or activates a surface of a plating base layer. While the two pre-soak modules 300 are disposed to be arranged in the vertical direction in this embodiment, the number of pre-soak modules 300 and arrangement of the pre-soak modules 300 are arbitrary. The plating module 400 performs the plating process on the substrate. There are two sets of the 12 plating modules 400 disposed to be arranged by three in the vertical direction and by four in the horizontal direction, and the total 24 plating modules 400 are arranged in this embodiment, but the number of plating modules 400 and arrangement of the plating modules 400 are arbitrary.

The spin rinse dryer 600 is a module for rotating the substrate after the cleaning process at high speed and drying the substrate. While the two spin rinse dryers are disposed to be arranged in the vertical direction in this embodiment, the number of spin rinse dryers and arrangement of the spin rinse dryers are arbitrary. The transfer device 700 is a device for transferring the substrate between the plurality of modules inside the plating apparatus 1000. The control module 800 is configured to control the plurality of modules in the plating apparatus 1000 and can be configured of, for example, a general computer including input/output interfaces with an operator or a dedicated computer.

An example of a sequence of the plating processes by the plating apparatus 1000 will be described. First, the substrate housed in the cassette is loaded on the load port 100.

Subsequently, the transfer robot 110 grips the substrate from the cassette at the load port 100 and transfers the substrate to the aligners 120. The aligner 120 adjusts the position of the orientation flat, the notch, or the like of the substrate in the predetermined direction. The transfer robot 110 grips or releases the substrate whose direction is adjusted with the aligners 120 to the transfer device 700.

The transfer device 700 transfers the substrate received from the transfer robot 110 to the plating module 400. The plating module 400 performs a pre-wet process on the substrate. The transfer device 700 transfers the substrate on which the pre-wet process has been performed to the pre-soak module 300. The pre-soak module 300 performs the pre-soak process on the substrate. The transfer device 700 transfers the substrate on which the pre-soak process has been performed to the plating module 400. The plating module 400 performs the plating process on the substrate. Furthermore, the plating module 400 performs the cleaning process on the substrate on which the plating process has been performed.

The transfer device 700 transfers the substrate on which the cleaning process has been performed to the spin rinse dryer 600. The spin rinse dryer 600 performs the drying process on the substrate. The transfer robot 110 receives the substrate from the spin rinse dryer 600 and transfers the substrate on which the drying process has been performed to the cassette at the load port 100. Finally, the cassette housing the substrate is unloaded from the load port 100.

<Configuration of Plating Module>

Figure 3:
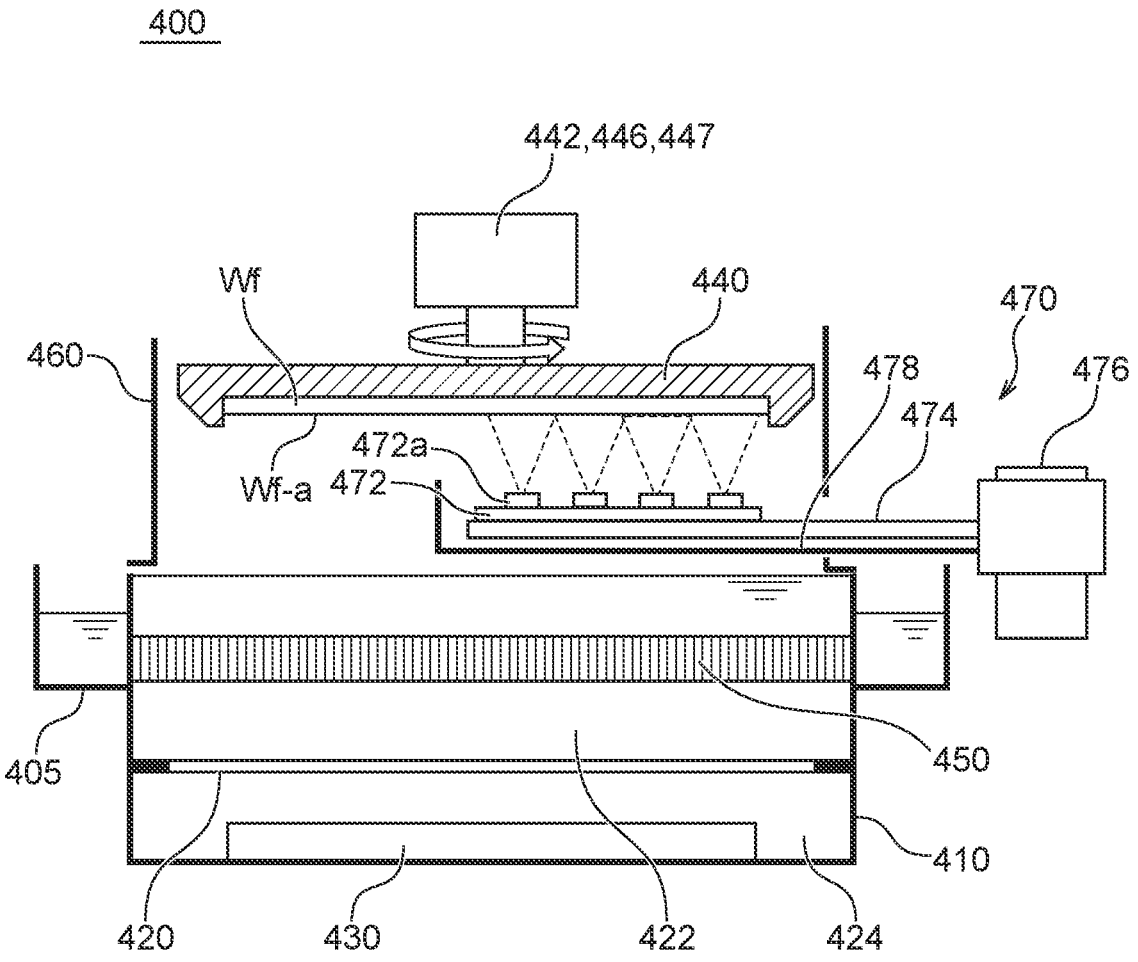
FIG. 3 is a vertical cross-sectional view schematically illustrating a configuration of a plating module according to this embodiment.

Next, the configuration of the plating modules 400 will be described. Since the 24 plating modules 400 in this embodiment have the identical configuration, only one of the plating modules 400 will be described. FIG. 3 is a vertical cross-sectional view schematically illustrating the configuration of the plating module 400 of this embodiment. As illustrated in FIG. 3, the plating module 400 includes a plating tank 410 for housing a plating solution. The plating tank 410 is a container having a cylindrical side wall and a circular-shaped bottom wall and has a circular-shaped opening formed on an upper portion. Further, the plating module 400 includes an overflow tank 405 arranged on an outer side of the upper opening of the plating tank 410. The overflow tank 405 is a container for receiving the plating solution overflowing from the upper opening of the plating tank 410.

The plating module 400 includes a membrane 420 that separates an inside of the plating tank 410 in the vertical direction. The inside of the plating tank 410 is divided into a cathode region 422 and an anode region 424 by the membrane 420. The cathode region 422 and the anode region 424 are each filled with the plating solution. An anode 430 is arranged on the bottom surface of the plating tank 410 in the anode region 424. In the cathode region 422, an ionically resistive element 450 is arranged to be opposed to the membrane 420. The ionically resistive element 450 is a member for intending homogenization of the plating process on a surface to be plated Wf-a of a substrate Wf and is configured of a plate-shaped member in which multiple holes are formed.

The plating module 400 includes a substrate holder 440 for holding the substrate Wf with the surface to be plated Wf-a facing downward. The plating module 400 includes an elevating mechanism 442 for elevating the substrate holder 440. For example, the elevating mechanism 442 can be achieved by a known mechanism, such as a motor. Further, the plating module 400 includes a rotation mechanism 446 for rotating the substrate holder 440 so that the substrate Wf rotates around a virtual rotation axis perpendicularly extending at the center of the surface to be plated Wf-a. For example, the rotation mechanism 446 can be achieved by a known mechanism, such as a motor.

The plating module 400 is configured to perform the plating process on the surface to be plated Wf-a of the substrate Wf by immersing the substrate Wf in the plating solution in the cathode region 422 using the elevating mechanism 442 and applying a voltage between the anode 430 and the substrate Wf while rotating the substrate Wf using the rotation mechanism 446.

Further, the plating module 400 includes an inclination mechanism 447 configured to incline the substrate holder 440. For example, the inclination mechanism 447 can be achieved by a known mechanism, such as a tilt mechanism.

The plating module 400 includes a cover member 460 arranged above the plating tank 410 and a cleaning device 470 for performing the cleaning process of the substrate Wf held by the substrate holder 440. The following will describe the cover member 460 and the cleaning device 470.

<Cover Member>

Figure 4:
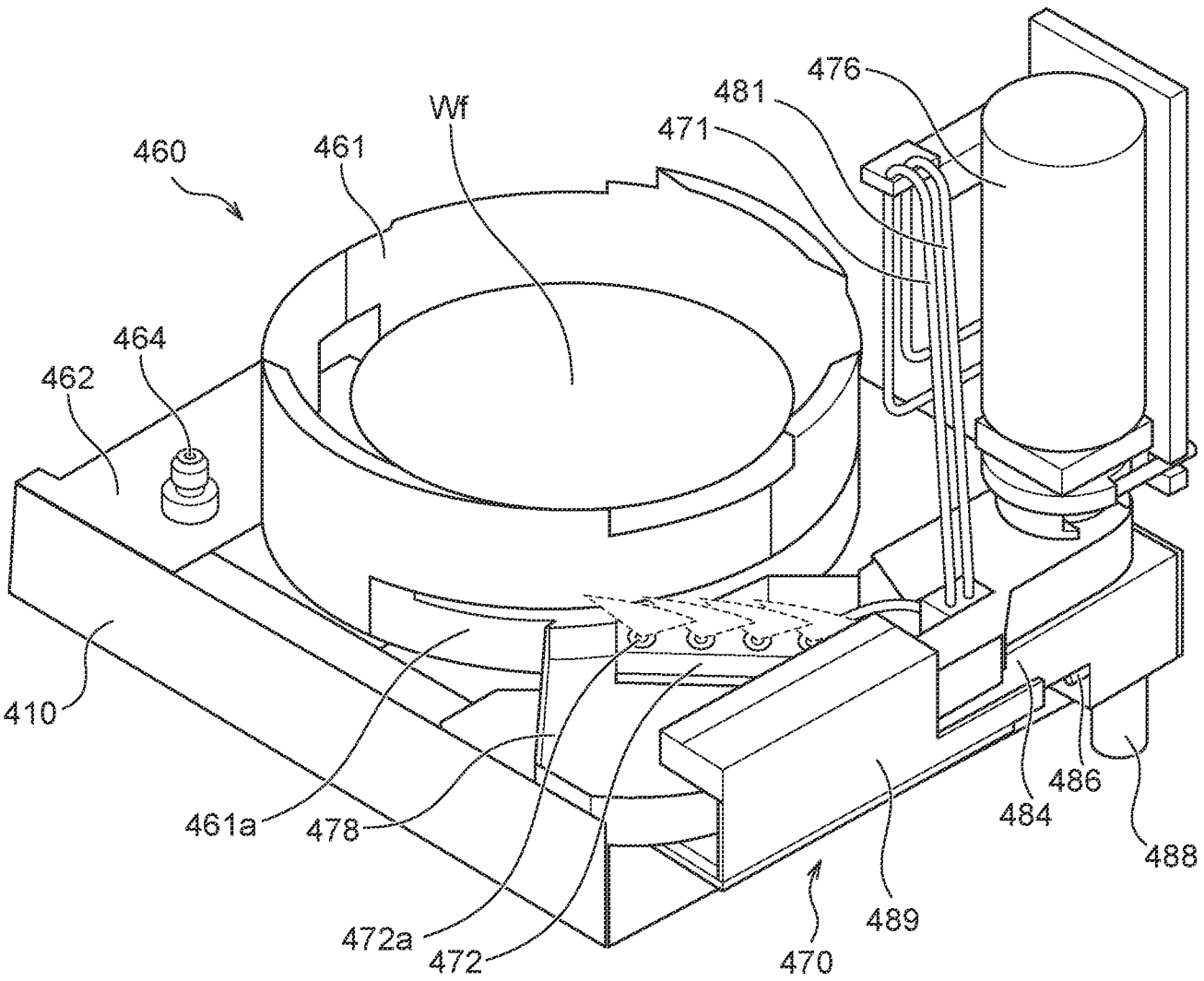
FIG. 4 is a perspective view schematically illustrating the configuration of the plating module according to this embodiment.

FIG. 4 is a perspective view schematically illustrating the configuration of the plating module of this embodiment. As illustrated in FIG. 4, the cover member 460 has a cylindrical side wall 461 arranged above the plating tank 410. The side wall 461 is arranged to surround an elevating path of the substrate holder 440. Further, the cover member 460 has a bottom wall 462 connected to the lower end of the side wall 461. The bottom wall 462 is a plate-shaped member that covers an outer side of the upper opening of the plating tank 410 with respect to the side wall 461.

As illustrated in FIG. 4, an exhaust outlet 464 is formed in the bottom wall 462. Although not illustrated, the exhaust outlet 464 is communicated with an outside of the plating module 400. Therefore, an atmosphere generated by causing the plating solution in the plating tank 410 to turn to mist (plating solution atmosphere) is discharged to the outside of the plating module 400 via the exhaust outlet 464.

As illustrated in FIG. 4, an opening 461*a* is formed in the side wall 461 of the cover member 460. This opening 461*a* becomes a passage for moving the cleaning device 470 between an outside and an inside of the side wall 461.

<Cleaning Device>

Figure 5:
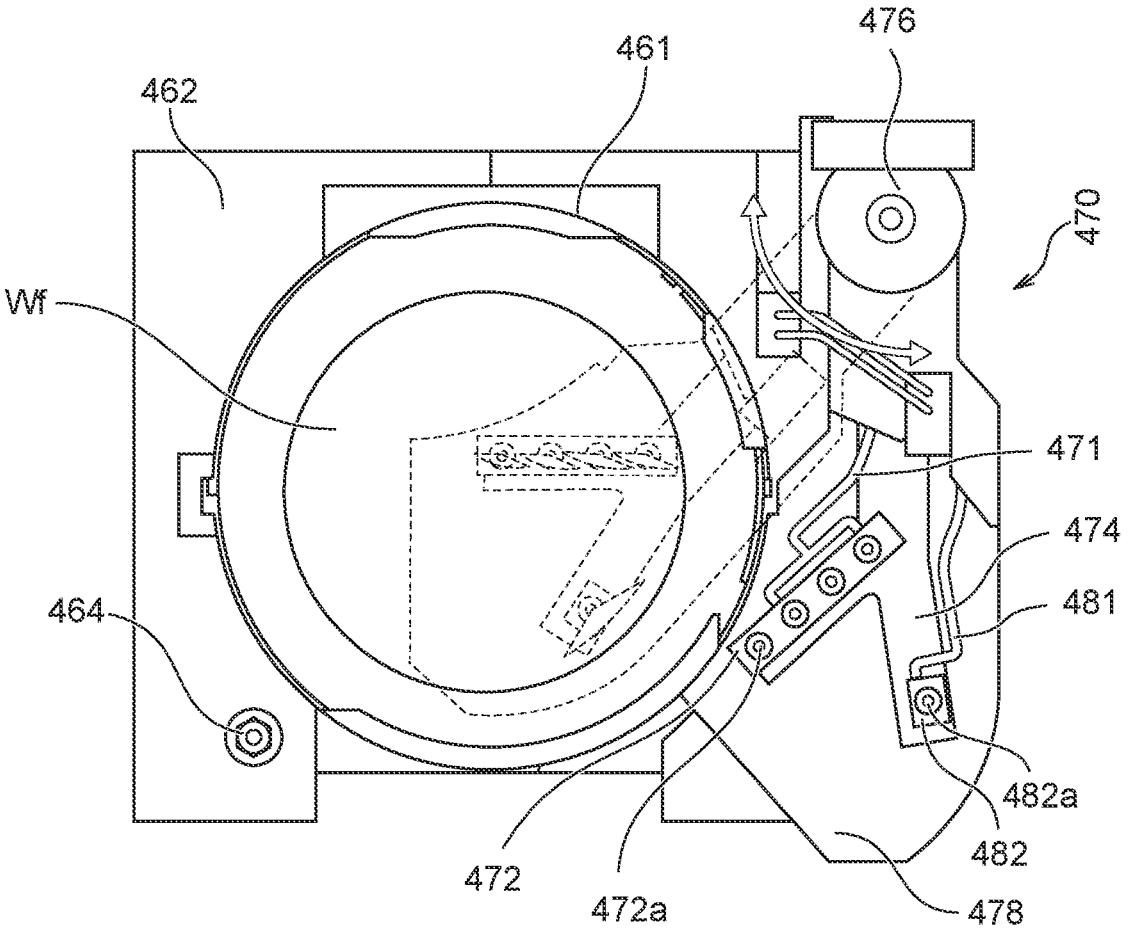
FIG. 5 is a plan view schematically illustrating the configuration of the plating module according to this embodiment.

Next, the cleaning device 470 will be described. FIG. 5 is a plan view schematically illustrating the configuration of the plating module according to this embodiment. Note that FIG. 5 omits illustration of a nozzle cleaning cover described later for convenience of explanation. FIG. 5 illustrates a state where the substrate cleaning member 472 and the contact cleaning member 482 are arranged at a retracted position by a solid line and illustrates a state where the substrate cleaning member 472 and the contact cleaning member 482 are arranged at a cleaning position by a dashed line.

As illustrated in FIG. 3 to FIG. 5, the cleaning device 470 includes a substrate cleaning member 472 for cleaning the surface to be plated Wf-a of the substrate Wf held by the substrate holder 440. The substrate cleaning member 472 includes a plurality (four pieces, in this embodiment) of substrate cleaning nozzles 472*a*. The plurality of substrate cleaning nozzles 472*a* are arranged along the radial direction of the substrate Wf or a direction intersecting with the rotation direction of the substrate Wf when the substrate cleaning member 472 is arranged at the cleaning position. A pipe 471 is connected to the substrate cleaning member 472. A cleaning liquid (such as pure water) supplied from a liquid source (not illustrated) is sent to the substrate cleaning member 472 via the pipe 471 and discharged from each of the plurality of substrate cleaning nozzles 472*a*.

Further, the cleaning device 470 includes a contact cleaning member 482 for cleaning a contact member for feeding power to the substrate Wf held by the substrate holder 440. The contact cleaning member 482 includes a contact cleaning nozzle 482*a* for discharging the cleaning liquid. A pipe 481 is connected to the contact cleaning member 482. A cleaning liquid (such as pure water) supplied from a liquid source (not illustrated) is sent to the contact cleaning member 482 via the pipe 481 and discharged from the contact cleaning nozzle 482*a*. Details of cleaning of the contact member using the contact cleaning member 482 will be described below.

The cleaning device 470 includes a driving mechanism 476 configured to turn an arm 474. For example, the driving mechanism 476 can be achieved by a known mechanism, such as a motor. The arm 474 is a plate-shaped member extending in the horizontal direction from the driving mechanism 476. The substrate cleaning member 472 and the contact cleaning member 482 are held on the arm 474. The driving mechanism 476 is configured to move the substrate cleaning member 472 and the contact cleaning member 482 between the cleaning position between the plating tank 410 and the substrate holder 440 and the retracted position retracted from between the plating tank 410 and the substrate holder 440 by turning the arm 474.

As illustrated in FIG. 4 and FIG. 5, the cleaning device 470 includes a tray member 478 arranged below the substrate cleaning member 472. The tray member 478 is a container configured to receive the cleaning liquid that has dropped after being discharged from the substrate cleaning member 472 and colliding with the surface to be plated Wf-a of the substrate Wf. Further, the tray member 478 is configured to receive the cleaning liquid that has dropped after being discharged from the contact cleaning member 482 and colliding with the contact member. In this embodiment, the whole of the substrate cleaning member 472, the contact cleaning member 482, and the arm 474 are housed in the tray member 478. The driving mechanism 476 is configured to turn the substrate cleaning member 472, the contact cleaning member 482, the arm 474, and the tray member 478 together between the cleaning position and the retracted position. However, the driving mechanism 476 may be configured to drive the substrate cleaning member 472, the contact cleaning member 482, and the arm 474 separately from the tray member 478.

Figure 6:
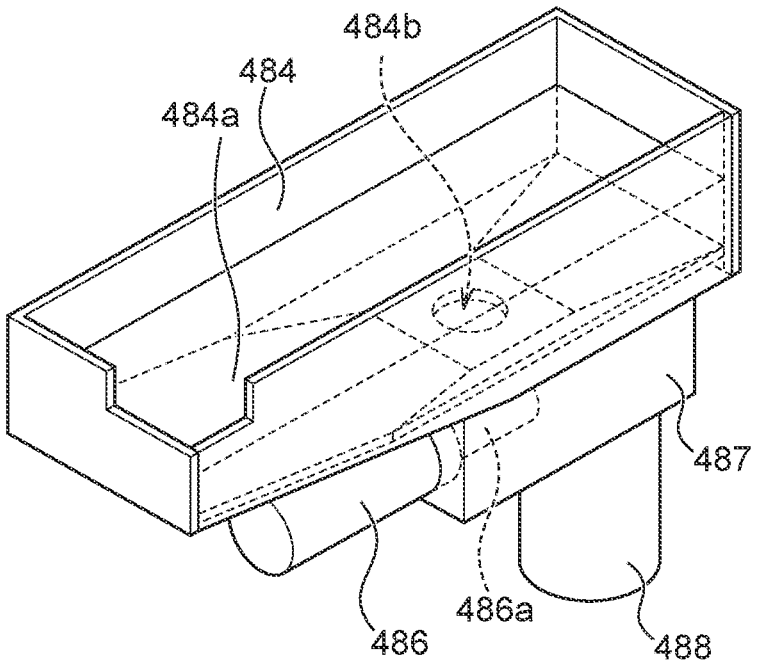
FIG. 6 is a perspective view schematically illustrating configurations of a fixed tray member and an electrical conductivity meter.
Figure 7:
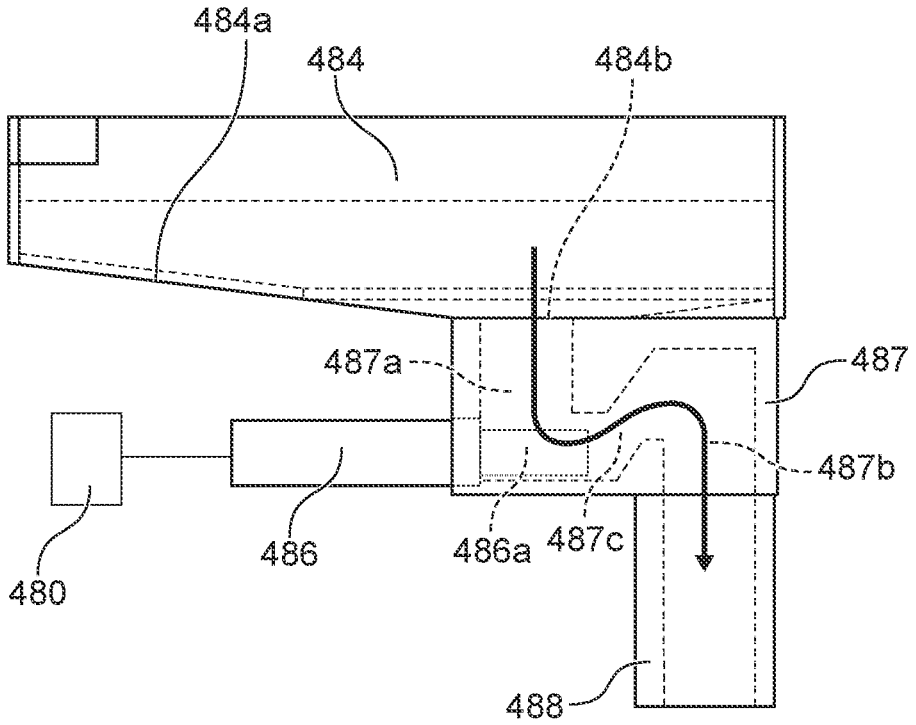
FIG. 7 is a vertical cross-sectional view schematically illustrating the configurations of the fixed tray member and the electrical conductivity meter.

As illustrated in FIG. 4, a fixed tray member 484 is arranged on a lower side of the tray member 478. The fixed tray member 484 is configured to receive the cleaning liquid that has dropped to the tray member 478 from the tray member 478. The fixed tray member 484 is arranged at the retracted position. FIG. 6 is a perspective view schematically illustrating configurations of the fixed tray member and an electrical conductivity meter. FIG. 7 is a vertical cross-sectional view schematically illustrating the configurations of the fixed tray member and the electrical conductivity meter. As illustrated in FIG. 6 and FIG. 7, the fixed tray member 484 is a box-shaped member having an open top surface. An opening 484*b* for flowing the cleaning liquid is formed in a bottom wall 484*a* of the fixed tray member 484.

The bottom wall 484*a* is inclined so as to become lower toward the opening 484*b* such that the opening 484*b* is arranged at the lowest position.

A coupling member 487 that couples the fixed tray member 484 and a drain tube 488 is arranged below the fixed tray member 484. The coupling member 487 includes a first flow passage 487*a* that extends from the opening 484*b* in a downward direction, a second flow passage 487*b* extending from the drain tube 488 in an upward direction, and a third flow passage 487*c* that communicates between the bottom portion of the first flow passage 487*a* and the top portion of the second flow passage 487*b*. Since the bottom portion of the first flow passage 487*a* is positioned lower than the top portion of the second flow passage 487*b*, the third flow passage 487*c* extends obliquely upward from the bottom portion of the first flow passage 487*a* toward the top portion of the second flow passage 487*b*. That is, the coupling member 487 includes an S-shaped flow passage. The cleaning liquid that has dropped to the fixed tray member 484 is discharged via the coupling member 487 and the drain tube 488.

The cleaning device 470 includes an electrical conductivity meter 486 for measuring a conductivity of the cleaning liquid that has dropped to the tray member 478. Specifically, a sensor 486*a* of the electrical conductivity meter 486 is arranged at the bottom portion of the first flow passage 487*a* of the coupling member 487. Since the coupling member 487 has the S-shaped flow passage, after the cleaning liquid flowed into the coupling member 487 is temporarily accumulated at the bottom portion of the first flow passage 487*a*, the cleaning liquid flows in one direction in the order from the third flow passage 487*c* and the second flow passage 487*b*. Accordingly, the sensor 486*a* of the electrical conductivity meter 486 is immersed into the cleaning liquid that is constantly subject to liquid replacement, the conductivity of the cleaning liquid can be accurately measured over time.

<Cleaning of Substrate>

When the plating process ends, the plating module 400 moves up the substrate holder 440 from the plating tank 410 by the elevating mechanism 442 and arranges the substrate holder 440 at a position surrounded by the cover member 460 (side wall 461). The plating module 400 arranges the substrate cleaning member 472 at the cleaning position as indicated by the dashed line in FIG. 5. This causes the substrate cleaning nozzles 472*a* to be aimed toward the surface to be plated Wf-a of the substrate Wf. The plating module 400 rotates the substrate holder 440 by the rotation mechanism 446. For example, the rotation mechanism 446 is configured to rotate the substrate holder 440 at a rotation speed of 1 rpm to 20 rpm. Further, the plating module 400 cleans the surface to be plated Wf-a of the substrate Wf in a state where the substrate holder 440 is inclined by the inclination mechanism 447. The following describes this point.

Figure 8:
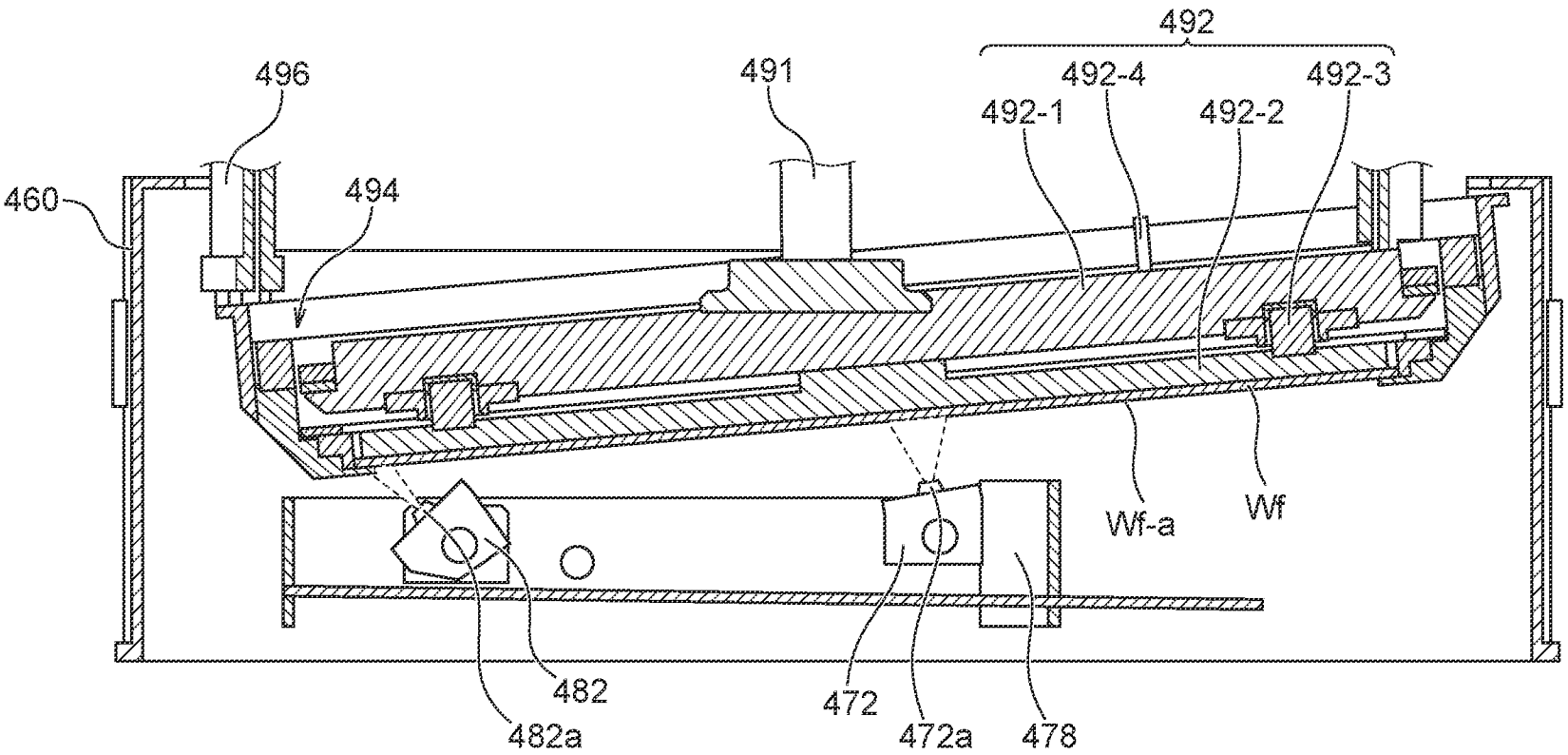
FIG. 8 is a vertical cross-sectional view schematically illustrating the configuration of the plating module according to this embodiment.
Figure 9:
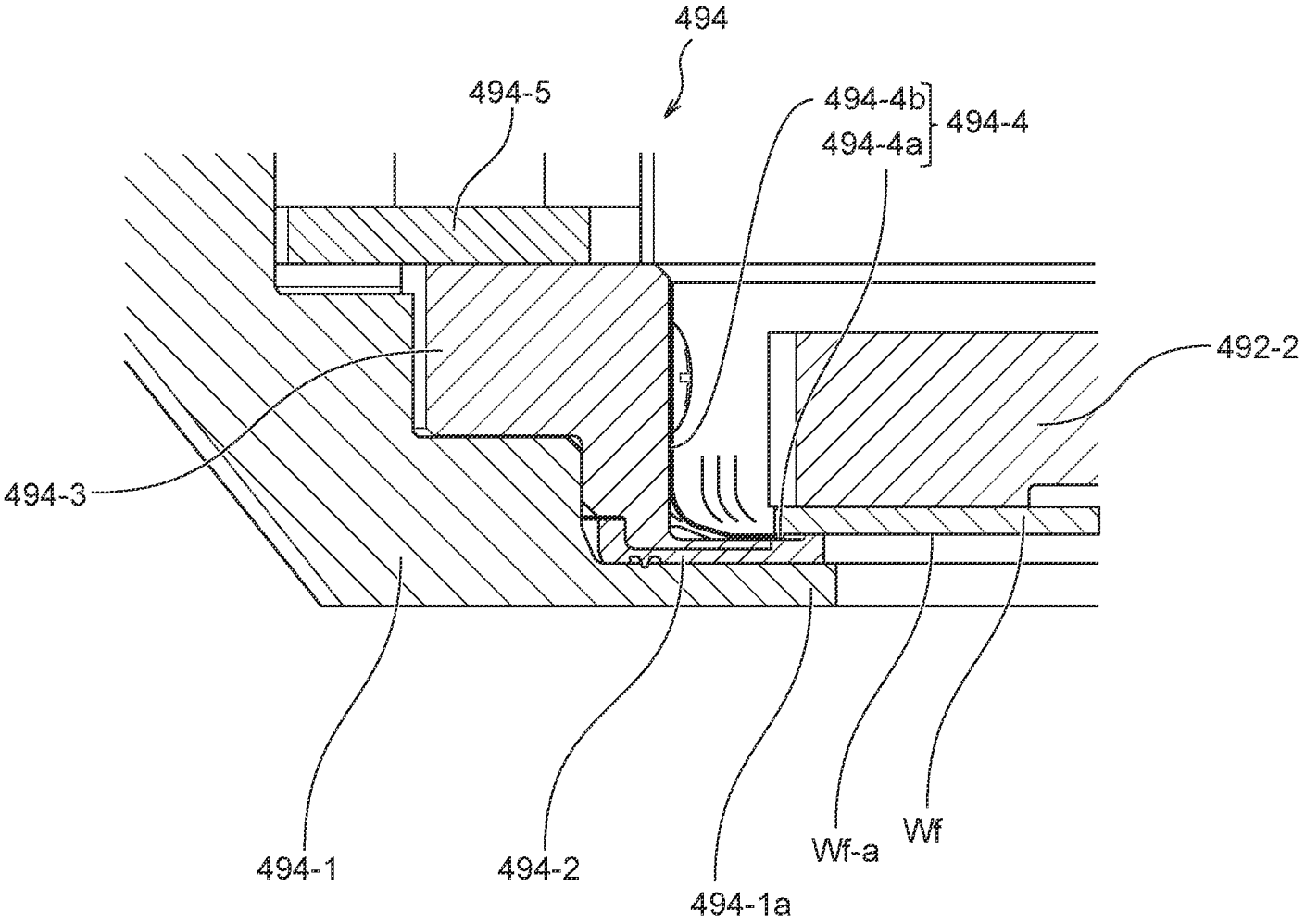
FIG. 9 is a vertical cross-sectional view schematically illustrating a part of an enlarged configuration of the plating module according to this embodiment.

FIG. 8 is a vertical cross-sectional view schematically illustrating the configuration of the plating module according to this embodiment. FIG. 9 is a vertical cross-sectional view schematically illustrating a part of an enlarged configuration of the plating module according to this embodiment.

As illustrated in FIG. 8, the substrate holder 440 includes a supporting mechanism 494 for supporting the outer peripheral portion of the surface to be plated Wf-a of the substrate Wf, a back plate assembly 492 for sandwiching the substrate Wf together with the supporting mechanism 494, and a rotation shaft 491 extending vertically upward from the back plate assembly 492. The supporting mechanism 494 is a ring-shaped member having an opening in the center for exposing the surface to be plated Wf-a of the substrate Wf and is suspended and held by a column member 496.

The back plate assembly 492 includes a circular plate-shaped floating plate 492-2 for sandwiching the substrate Wf together with the supporting mechanism 494. The floating plate 492-2 is arranged on the back surface side of the surface to be plated Wf-a of the substrate Wf. Further, the back plate assembly 492 includes a circular plate-shaped back plate 492-1 arranged above the floating plate 492-2. Further, the back plate assembly 492 includes a floating mechanism 492-4 for biasing the floating plate 492-2 to a direction away from the back surface of the substrate Wf and a pushing mechanism 492-3 for pressing the floating plate 492-2 to the back surface of the substrate Wf against a biasing force by the floating mechanism 492-4.

The floating mechanism 492-4 includes a compression spring attached between the upper end of a shaft that passes through the back plate 492-1 from the floating plate 492-2 and extends upward and the back plate 492-1. The floating mechanism 492-4 is configured to lift the floating plate 492-2 upward via the shaft by a compression reactive force of the compression spring and bias the floating plate 492-2 to the direction away from the back surface of the substrate Wf.

The pushing mechanism 492-3 is configured to press the floating plate 492-2 downward by supplying a fluid to the floating plate 492-2 via a flow passage formed in an inside of the back plate 492-1. While the fluid is supplied, the pushing mechanism 492-3 presses the substrate Wf to the supporting mechanism 494 by a force stronger than the biasing force by the floating mechanism 492-4.

As illustrated in FIG. 9, the supporting mechanism 494 includes a ring-shaped supporting member 494-1 for supporting the outer peripheral portion of the surface to be plated Wf-a of the substrate Wf. The supporting member 494-1 has a flange 494-1*a* projecting to an outer peripheral portion of the lower surface of the back plate assembly 492 (floating plate 492-2). A ring-shaped sealing member 494-2 is arranged on the flange 494-1*a*. The sealing member 494-2 is a member having elasticity. The supporting member 494-1 supports the outer peripheral portion of the surface to be plated Wf-a of the substrate Wf via the sealing member 494-2. By sandwiching the substrate Wf between the sealing member 494-2 and the floating plate 492-2, sealing is made between the supporting member 494-1 (substrate holder 440) and the substrate Wf.

The supporting mechanism 494 includes a ring-shaped pedestal 494-3 attached on the inner peripheral surface of the supporting member 494-1 and a ring-shaped conductive member 494-5 attached on the upper surface of the pedestal 494-3. The pedestal 494-3 is a member having a conductive property of, for example, stainless steel and the like. The conductive member 494-5 is a ring-shaped member having a conductive property of, for example, copper and the like.

The supporting mechanism 494 includes a contact member 494-4 for feeding power to the substrate Wf. The contact member 494-4 is circularly attached on the inner peripheral surface of the pedestal 494-3 by a screw or the like. The supporting member 494-1 holds the contact member 494-4 via the pedestal 494-3. The contact member 494-4 is a member having a conductive property for feeding power to the substrate Wf held by the substrate holder 440 from a power source (not illustrated). The contact member 494-4 has a plurality of substrate contact points 494-4*a* that are in contact with the outer peripheral portion of the surface to be plated Wf-a of the substrate Wf and a main body 494-4*b* extending above with respect to the substrate contact points 494-4*a*.

When the plating process is performed on the substrate Wf, sealing is made between the supporting member 494-1 and the substrate Wf by sandwiching the substrate Wf between the sealing member 494-2 and the back plate assembly 492.

As illustrated in FIG. 8, the inclination mechanism 447 inclines the substrate holder 440. This also inclines the substrate Wf held by the substrate holder 440. The substrate cleaning member 472 is configured to be inclined by the inclination mechanism 447 and discharge the cleaning liquid to the surface to be plated Wf-a of the substrate Wf rotated by the rotation mechanism 446. This allows cleaning the whole surface to be plated Wf-a of the substrate Wf.

In the above description, while the example in which the substrate cleaning member 472 is used for cleaning the plating solution from the surface to be plated Wf-a of the substrate Wf after the plating process has been described, the present invention is not limited to this. In the plating module 400, the substrate cleaning member 472 can be used for the pre-wet process. That is, using the substrate cleaning member 472, the plating module 400 wets the surface to be plated Wf-a of the substrate Wf before the plating process with the process liquid, such as pure water or deaerated water, thereby allowing replacing air inside a pattern formed on a substrate surface with the process liquid.

<Cleaning of Contact Member>

Figure 10:
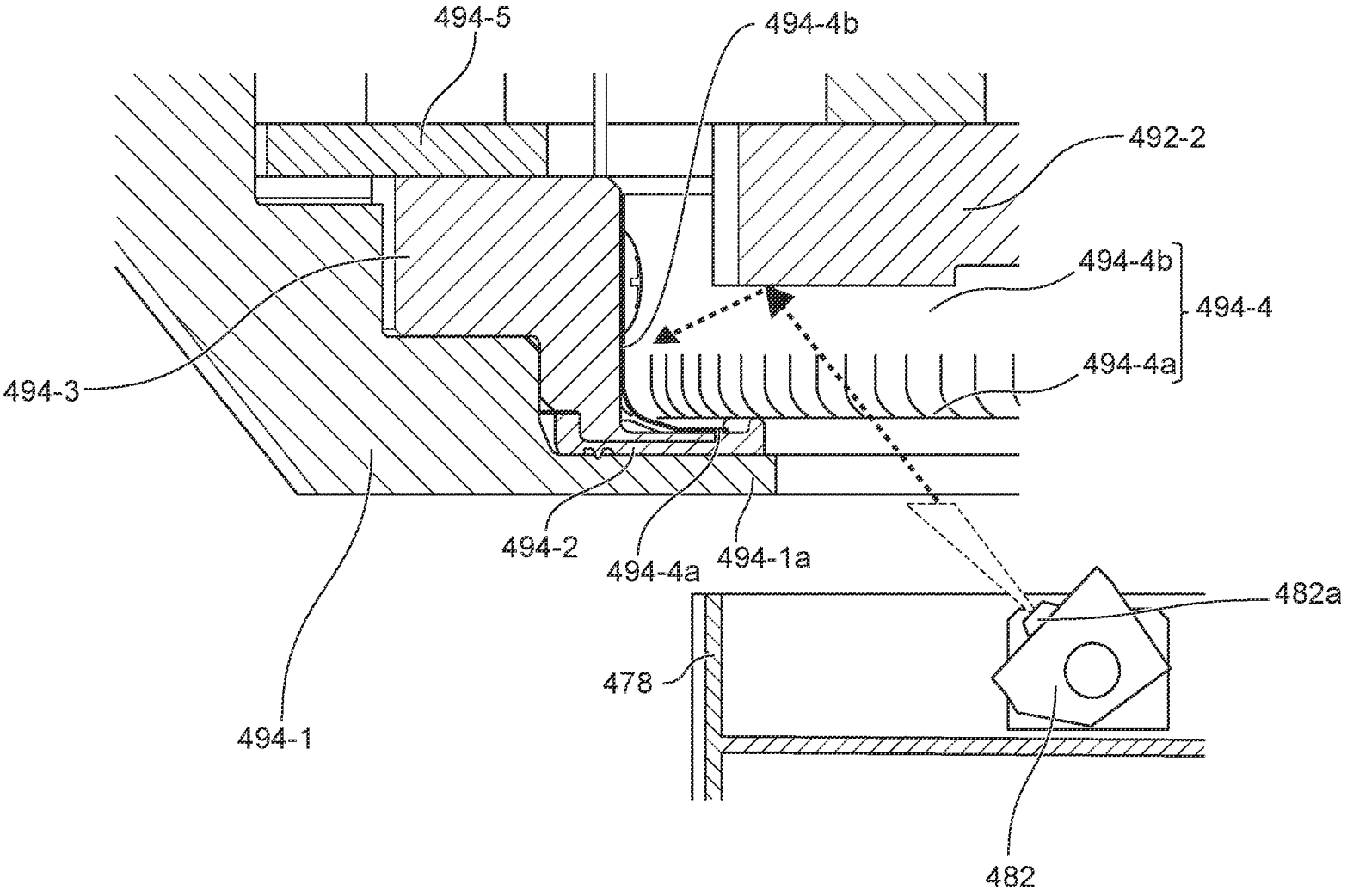
FIG. 10 is a drawing schematically illustrating cleaning of a contact member by the plating module according to this embodiment.

Next, cleaning of the contact member attached to the substrate holder 440 will be described. FIG. 10 is a drawing schematically illustrating cleaning of the contact member by the plating module of this embodiment. As illustrated in FIG. 10, in this embodiment, when the contact member 494-4 is cleaned, the back plate assembly 492 (floating plate 492-2) is arranged at the position surrounded by the contact member 494-4.

The contact cleaning member 482 is configured to discharge the cleaning liquid toward the lower surface of the back plate assembly 492 and aim the cleaning liquid that has bounced after hitting against the lower surface of the back plate assembly 492 toward the main body 494-4*b*. The cleaning liquid that has bounced after hitting against the lower surface of the back plate assembly 492 flows downward from the main body 494-4*b* by gravity after colliding with the main body 494-4*b*. This causes the plating solution to drop together with the cleaning liquid and be recovered in the tray member 478 when dirt or dust accumulates on the main body 494-4*b* and the substrate contact points 494-4*a* or there is a leakage in the sealing member 494-2.

While the example in which the contact member 494-4 is cleaned in a state where the substrate holder 440 is horizontalized has been described above, the present invention is not limited to this. The contact cleaning member 482 may clean the contact member 494-4 in a state where the substrate holder 440 is inclined by the inclination mechanism 447. While the example in which the cleaning liquid is discharged to the lower surface of the back plate assembly 492 has been described above, the present invention is not limited to this. When the contact member 494-4 is cleaned, the back plate assembly 492 may be arranged at a position higher than the position surrounded by the contact member 494-4. In this case, the contact cleaning member 482 can discharge the cleaning liquid to the main body 494-4*b* of the contact member from the lower side of the substrate holder 440.

<Nozzle Cleaning Cover>

Figure 11:
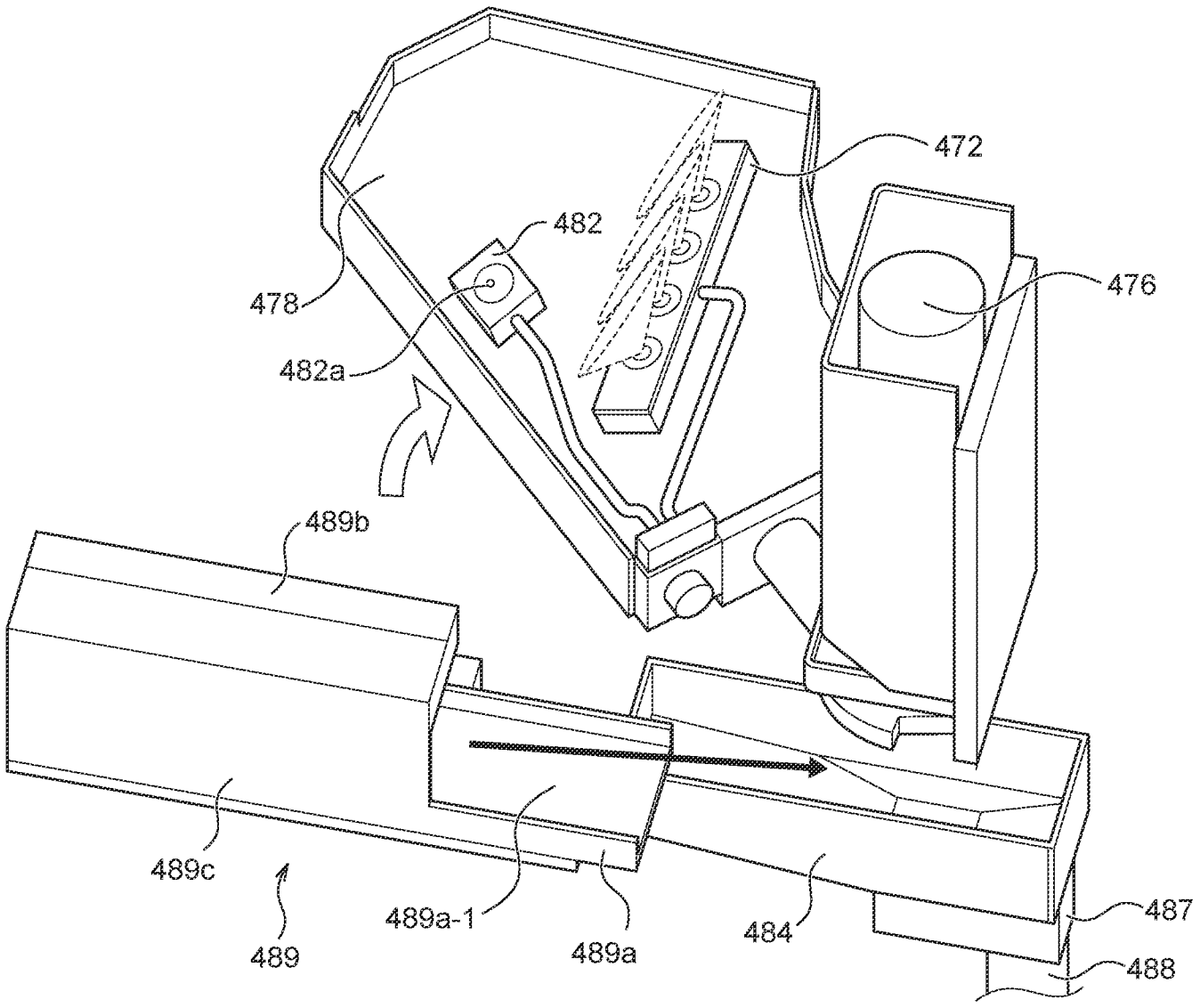
FIG. 11 is a perspective view schematically illustrating a configuration of a nozzle cleaning cover.
Figure 12:
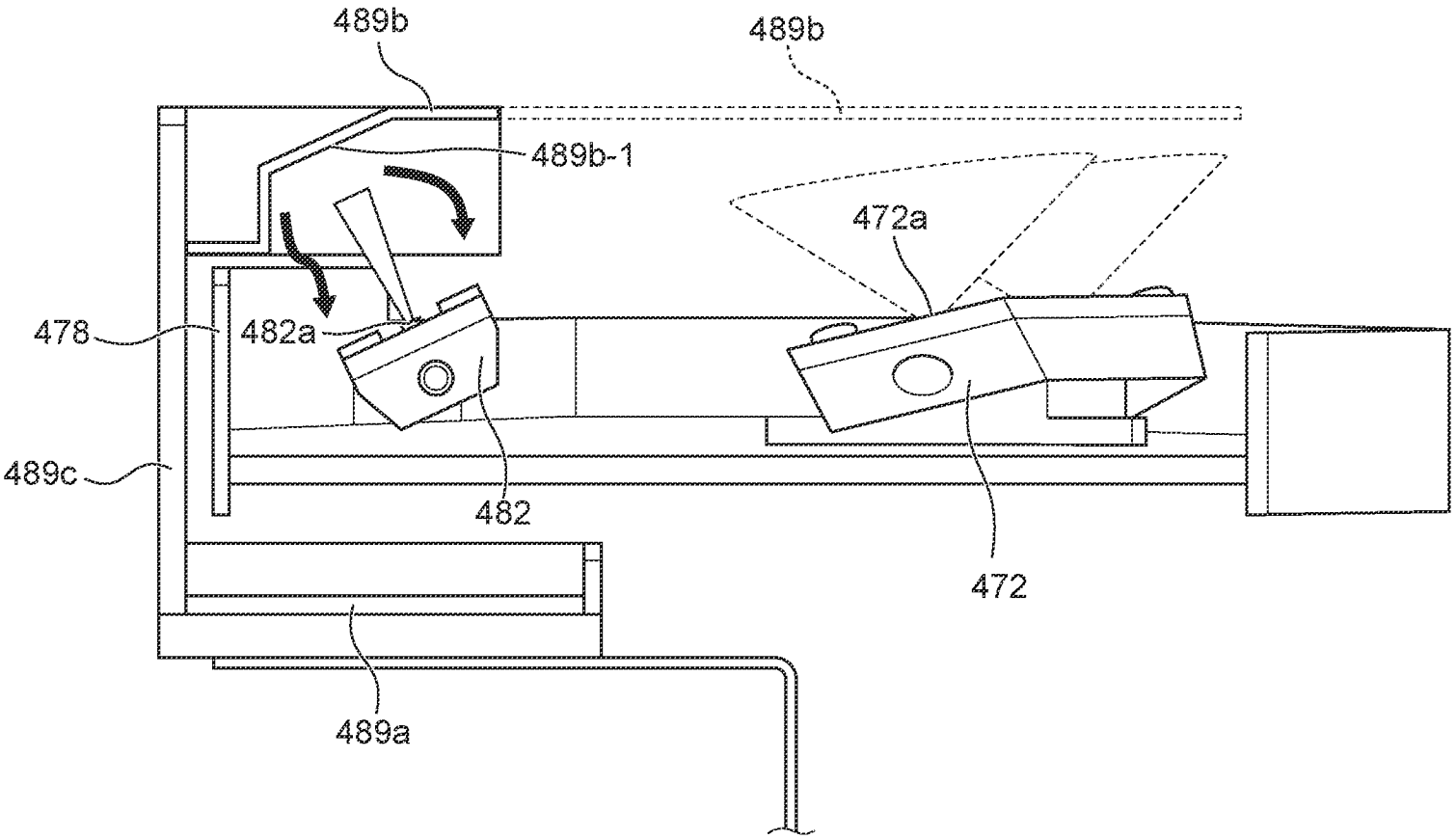
FIG. 12 is a side view schematically illustrating the configuration of the nozzle cleaning cover.

As illustrated in FIG. 4, the cleaning device 470 includes a nozzle cleaning cover for cleaning the contact cleaning member 482. The following will describe the nozzle cleaning cover. FIG. 11 is a perspective view schematically illustrating a configuration of the nozzle cleaning cover. FIG. 11 illustrates a state in which the substrate cleaning member 472 and the contact cleaning member 482 are arranged at the cleaning position. FIG. 12 is a side view schematically illustrating the configuration of the nozzle cleaning cover. FIG. 11 illustrates the state in which the substrate cleaning member 472 and the contact cleaning member 482 are arranged at the retracted position.

As illustrated in FIG. 11, a nozzle cleaning cover 489 is mounted to the fixed tray member 484. The nozzle cleaning cover 489 is configured to cover the contact cleaning member 482 when the contact cleaning member 482 is at the retracted position. Specifically, the nozzle cleaning cover 489 includes a bottom plate tray 489*a* mounted to the fixed tray member 484, an upper plate 489*b* arranged on the upper side of the bottom plate tray 489*a* so as to be opposed to the bottom plate tray 489*a*, and a side plate 489*c* that couples the bottom plate tray 489*a* and the upper plate 489*b*.

Since the nozzle cleaning cover 489 is fixed to the fixed tray member 484, even when the tray member 478 performs turning movement between the cleaning position and the retracted position, the position of the nozzle cleaning cover 489 is not changed. Accordingly, as illustrated in FIG. 11, with the contact cleaning member 482 at the cleaning position, the nozzle cleaning cover 489 does not cover the upper portion of the contact cleaning nozzle 482*a*. Meanwhile, as illustrated in FIG. 12, with the contact cleaning member 482 at the retracted position, since the contact cleaning member 482 is arranged at a position sandwiched between the bottom plate tray 489*a* and the upper plate 489*b*, the nozzle cleaning cover 489 (upper plate 489*b*) covers the upper portion of the contact cleaning nozzle 482*a*.

When the cleaning liquid is discharged from the contact cleaning nozzle 482*a* with the contact cleaning member 482 at the retracted position, the cleaning liquid collides with the upper plate 489*b* immediately above the contact cleaning nozzle 482*a*, and drops to the contact cleaning nozzle 482*a*. More specifically, as illustrated in FIG. 12, the upper plate 489*b* includes a receiving surface 489*b*-1 formed to be opposed so as to be perpendicular to the discharge direction of the cleaning liquid of the contact cleaning nozzle 482*a*. Accordingly, even when the contact cleaning nozzle 482*a* is arranged to be inclined with respect to the vertical direction, the cleaning liquid discharged from the contact cleaning nozzle 482*a* collides with the receiving surface 489*b*-1 and easily drops to the contact cleaning nozzle 482*a*. Thus, the contact cleaning nozzle 482*a* is cleaned by the cleaning liquid discharged from itself. Additionally, the cleaning liquid that has collided with the upper plate 489*b* to drop flows through the tray member 478, the fixed tray member 484, and the coupling member 487 and is discharged from the drain tube 488.

Additionally, after the tray member 478 moves to the cleaning position, the cleaning liquid attached to the upper plate 489*b* drops to the bottom plate tray 489*a*. Here, the bottom plate tray 489*a* includes an inclined surface 489*a*-1 inclined so as to descend toward the fixed tray member 484. Thus, the cleaning liquid that has dropped to the bottom plate tray 489*a* naturally flows down to the fixed tray member 484 via the inclined surface 489*a*-1 to be discharged.

According to this embodiment, the contact cleaning nozzle 482*a* and the flow passage of the cleaning liquid of the tray member 478 and the fixed tray member 484 can be cleaned. That is, there may be a case where cleaning the surface to be plated Wf-a of the substrate Wf drops the cleaning liquid containing the plating solution from the surface to be plated Wf-a and the cleaning liquid attaches to the contact cleaning nozzle 482*a*. Additionally, there may be a case where the cleaning liquid containing the plating solution drops from the surface to be plated Wf-a and remains in the flow passage of the cleaning liquid of the tray member 478 and the fixed tray member 484. When the cleaning liquid containing the plating solution attaches to the contact cleaning nozzle 482*a* and remains in the flow passage of the tray member 478 and the fixed tray member 484, it possibly adversely affects the subsequent leakage determination.

In contrast to this, according to this embodiment, before leakage determination, the contact cleaning nozzle 482*a* and the flow passage of the cleaning liquid of the tray member 478 and the fixed tray member 484 can be cleaned using the nozzle cleaning cover 489, and therefore accuracy of the leakage determination can be improved.

Note that the example of covering the contact cleaning nozzle 482*a* with the nozzle cleaning cover 489 (upper plate 489*b*) has been described in this embodiment, but the present invention is not limited to this. As indicated by the dashed line in FIG. 12, the nozzle cleaning cover 489 (upper plate 489*b*) may be formed so as to cover the upper portion of the substrate cleaning nozzle 472*a* in addition to the contact cleaning nozzle 482*a*. In this case, with the contact cleaning member 482 and the substrate cleaning member 472 at the retracted position, the cleaning liquid can be discharged from the contact cleaning nozzle 482*a* and the substrate cleaning nozzle 472*a*. This allows cleaning the contact cleaning nozzle 482*a* and substrate cleaning nozzle 472*a*.

<Determination Member for Leakage of Plating Solution>

As illustrated in FIG. 7, the plating module 400 includes a determination member 480 for determining presence or absence of a leakage of the plating solution to the arranged region of the contact member 494-4. The determination member 480 can be constituted by a general computer including, for example, an input/output device, an arithmetic device, and a storage device. The determination member 480 may be achieved as a part of the control module 800. The determination member 480 preliminarily has a conductivity (first conductivity) of the cleaning liquid measured by the electrical conductivity meter 486 when the cleaning liquid is discharged to the contact member of the substrate holder (the substrate holder in which a leakage of the plating solution is absent) serving as a reference. The determination member 480 is configured to determine presence or absence of the leakage of the plating solution to the arranged region of the contact member 494-4 based on comparison between the first conductivity (reference conductivity) and the conductivity (second conductivity) of the cleaning liquid measured for the substrate holder 440 to be subject to the determination for presence or absence of leakage by the electrical conductivity meter 486. The specific example of leakage determination by the determination member 480 will be described with reference to the flowcharts of the following leakage determination method.

<Leakage Determination Method>

Figure 13:
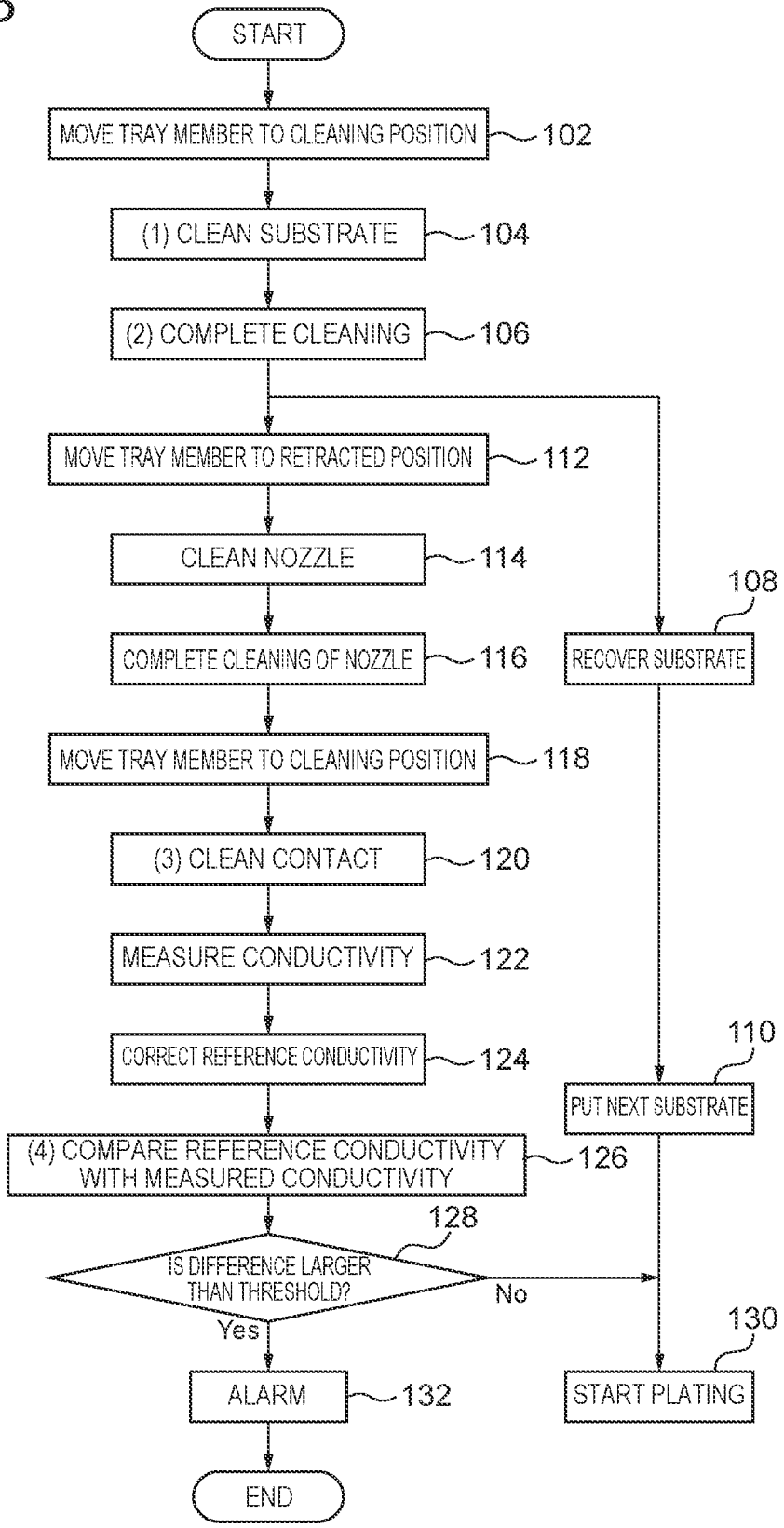
FIG. 13 is a flowchart depicting processes by the plating module according to this embodiment.
Figure 14:
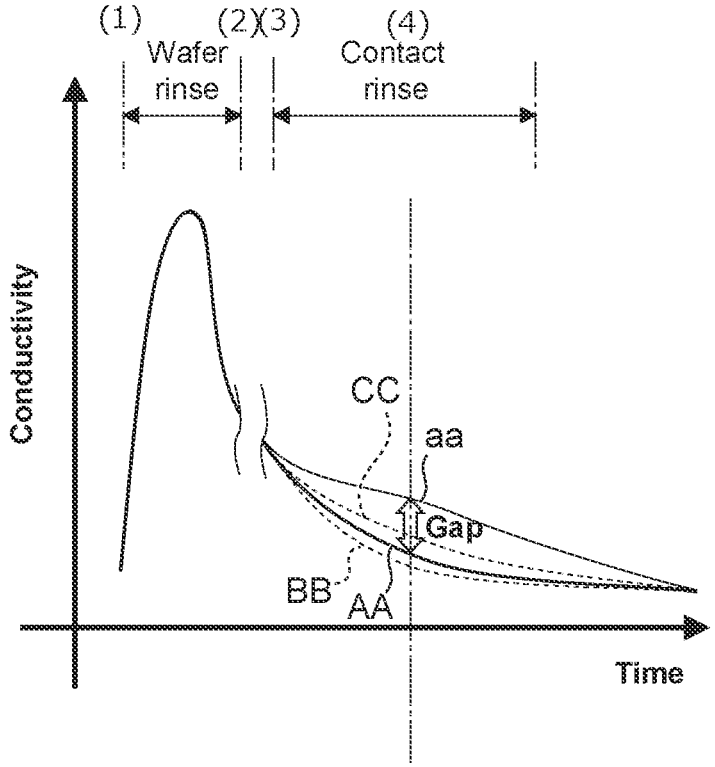
FIG. 14 is a drawing schematically illustrating transition of a conductivity of a cleaning liquid in the flowchart of FIG. 13.

A sequence of operations by the plating module 400 according to this embodiment will be described. FIG. 13 is a flowchart depicting processes by the plating module according to this embodiment. FIG. 14 is a drawing schematically illustrating transition of a conductivity of a cleaning liquid in the flowchart of FIG. 13. In FIG. 13, the horizontal axis indicates a time passage, and the vertical axis indicates a conductivity of the cleaning liquid measured by the electrical conductivity meter 486. The flowchart of FIG. 13 depicts respective processes after the substrate Wf held by the substrate holder 440 is immersed in the plating tank 410 and the plating process is performed.

As illustrated in FIG. 13, after the plating process, the plating module 400 moves the tray member 478 from the retracted position to the cleaning position using the driving mechanism 476 (Step 102). Subsequently, the plating module 400 discharges the cleaning liquid from the substrate cleaning nozzle 472*a* to clean the surface to be plated Wf-a of the substrate Wf (Step 104). Thus, since the cleaning liquid containing the plating solution flows to the electrical conductivity meter 486, as illustrated in FIG. 14, the conductivity of the cleaning liquid increases and then decreases. Subsequently, when the conductivity of the cleaning liquid measured by the electrical conductivity meter 486 becomes smaller than a predetermined threshold, the plating module 400 completes cleaning of the substrate Wf (Step 106).

When the cleaning of the substrate Wf is completed, the plating module 400 recovers the substrate Wf (Step 108) and installs the substrate Wf to be subject to the next plating process on the substrate holder 440 (Step 110). On the other hand, when the cleaning of the substrate Wf is completed, the plating module 400 moves the tray member 478 from the cleaning position to the retracted position using the driving mechanism 476 (Step 112). When the tray member 478 moves to the retracted position, the plating module 400 cleans the contact cleaning nozzle 482*a* (Step 114). That is, the plating module 400 discharges the cleaning liquid from the contact cleaning nozzle 482*a* with the nozzle cleaning cover 489 present immediately above the contact cleaning nozzle 482*a*. Thus, since the cleaning liquid that has collided with the nozzle cleaning cover 489 drops to the contact cleaning nozzle 482*a*, the contact cleaning nozzle 482*a* is cleaned. Additionally, the flow passage of the cleaning liquid of the tray member 478 and the fixed tray member 484 is also cleaned.

When the cleaning of the contact cleaning nozzle 482*a* is completed (Step 116), the plating module 400 moves the tray member 478 from the retracted position to the cleaning position using the driving mechanism 476 (Step 118). Subsequently, the plating module 400 discharges the cleaning liquid from the contact cleaning nozzle 482*a* to clean the contact member 494-4 (discharge step 120). Note that since the nozzle cleaning cover 489 is not at immediately above the contact cleaning nozzle 482*a* with the tray member 478 at the cleaning position, the cleaning liquid discharged from the contact cleaning nozzle 482*a* is supplied to the contact member 494-4.

Subsequently, the plating module 400 measures the conductivity of the cleaning liquid by the electrical conductivity meter 486 (measuring step 122). Subsequently, the plating module 400 corrects the first conductivity (reference conductivity) according to the type of the substrate to be subject to the plating process (Step 124). That is, a current density supplied to the surface to be plated of the substrate differs according to the type of the substrate to be subject to the plating process. As illustrated in FIG. 14, when a high current density is supplied to the substrate, the plating module 400 corrects the first conductivity such that a value of a first conductivity AA (reference conductivity) decreases (a corrected first conductivity BB in FIG. 14). This is correction to tighten criteria for leakage determination. On the other hand, in the case of the substrate to which a low current density is supplied, the plating module 400 corrects the first conductivity such that the value of the first conductivity AA (reference conductivity) increases (a corrected first conductivity CC in FIG. 14). This is correction to loosen the criteria for leakage determination. Note that the reference conductivity needs not to be corrected at the timing of Step 124, and as long as before execution of Step 126, the correction can be performed at any timing.

Subsequently, using the determination member 480, the plating module 400 compares the first conductivity (the first conductivity AA in this embodiment) corrected in Step 124 with the conductivity (second conductivity aa) measured in the measuring step 122 (Step 126). The plating module 400 obtains a difference (GAP) between the first conductivity and the second conductivity using the determination member 480 and determines whether the difference is larger than the threshold set in advance (determining step 128).

When the difference is equal to or less than the threshold set in advance (No in the determining step 128), the determination member 480 determines that the leakage of the plating solution to the arranged region of the contact member 494-4 is absent, and the plating process starts on the substrate Wf to be subject to the next plating process installed in Step 110 (Step 130). On the other hand, when the difference is larger than the threshold set in advance (Yes in the determining step 128), the determination member 480 determines that the leakage of the plating solution to the arranged region of the contact member 494-4 is present, an alarm is output (Step 132), and the process is terminated. That is, when the plating solution leaks to the arranged region of the contact member 494-4, since the plating solution is mixed with the cleaning liquid discharged to the contact member 494-4, the second conductivity measured by the electrical conductivity meter 486 increases. Therefore, when the second conductivity becomes larger than the threshold set in advance compared with the first conductivity measured in a state of no leakage of the plating solution, the determination member 480 can determine that leakage of the plating solution to the arranged region of the contact member 494-4 is present. The plating module 400 can output an alarm to promote, for example, inspection, repair, and exchange of the leakage portion of the substrate holder 440.

According to this embodiment, since presence or absence of the leakage of the plating solution to the arranged region of the contact member 494-4 can be determined, when presence of leakage is determined, the substrate holder can be, for example, inspected, repaired, and exchanged. As a result, a variation of an electrical resistance due to corrosion of the contact member or deposition or adherence of a medicinal solution in the contact member can be reduced, and therefore homogenization of the plating process can be improved.

Figure 15:
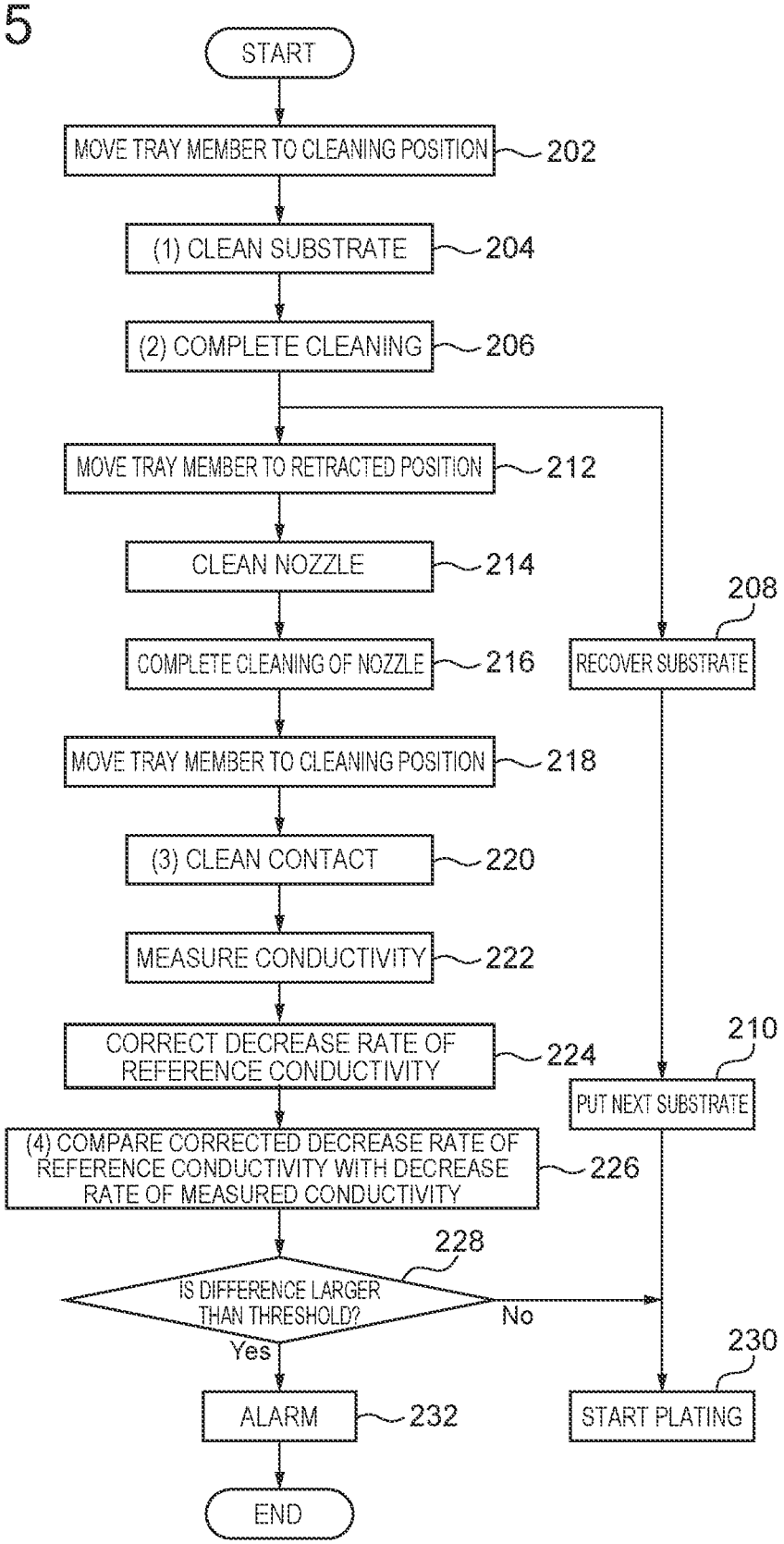
FIG. 15 is a flowchart depicting processes by the plating module according to this embodiment.
Figure 16:
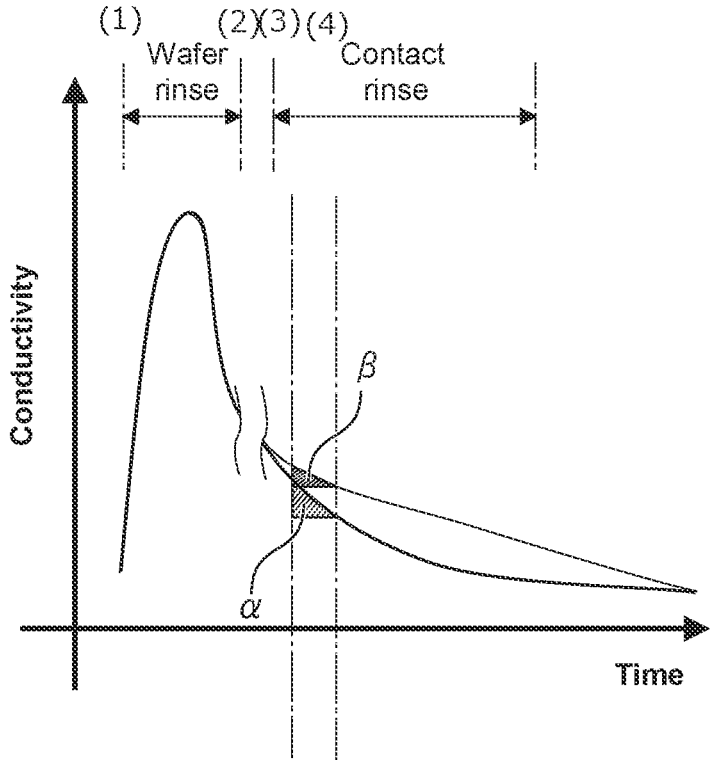
FIG. 16 is a drawing schematically illustrating transition of the conductivity of the cleaning liquid in the flowchart of FIG. 15.

Note that, in the above-described embodiments, the example of the determination member 480 determining presence or absence of leakage of the plating solution based on the difference between the first conductivity and the second conductivity has been described, but the present invention is not limited to this. FIG. 15 is a flowchart depicting processes by the plating module according to this embodiment. FIG. 16 is a drawing schematically illustrating transition of the conductivity of the cleaning liquid in the flowchart of FIG. 15. In the flowchart of FIG. 15, since Step 202 to Step 222 are similar to Step 102 to Step 122 in the flowchart of FIG. 13, the description will be omitted.

In the measuring step 222, after the conductivity of the cleaning liquid is measured, the plating module 400 corrects the decrease rate of the first conductivity according to the type of the substrate to be subject to the plating process (Step 224). That is, the current density supplied to the surface to be plated of the substrate differs according to the type of the substrate to be subject to the plating process. When a high current density is supplied to the substrate, the plating module 400 corrects a value of a decrease rate $\alpha$ of the first conductivity such that the value of the decrease rate $\alpha$ of the first conductivity increases. This is correction to tighten the criteria for leakage determination. On the other hand, when a low current density is supplied to the substrate, the plating module 400 corrects the decrease rate $\alpha$ of the first conductivity such that the value of the decrease rate $\alpha$ of the first conductivity decreases. This is correction to loosen the criteria for leakage determination. Note that the decrease rate of the first conductivity needs not to be corrected at the timing of Step 224, and as long as before execution of Step 226, the correction can be performed at any timing. The decrease rate of the conductivity indicates a reduction amount of conductivity per unit time.

Subsequently, the plating module 400 compares the decrease rate $\alpha$ of the first conductivity corrected in Step 224 with a decrease rate ß of the second conductivity measured in the measuring step 222 using the determination member 480 (Step 226). The plating module 400 obtains the difference between the decrease rate $\alpha$ of the first conductivity and the decrease rate $\beta$ of the second conductivity using the determination member 480 and determines whether the difference is larger than the threshold set in advance (determining step 228).

When the difference is equal to or less than the threshold set in advance (No in the determining step 228), the determination member 480 determines that the leakage of the plating solution to the arranged region of the contact member 494-4 is absent, and the plating process starts on the substrate Wf to be subject to the next plating process installed in Step 210 (Step 230). On the other hand, when the difference is larger than the threshold set in advance (Yes in the determining step 228), the determination member 480 determines that the leakage of the plating solution to the arranged region of the contact member 494-4 is present, an alarm is output (Step 232), and the process is terminated.

That is, when the plating solution leaks to the arranged region of the contact member 494-4, since the large amount of the plating solution is mixed with the cleaning liquid discharged to the contact member 494-4, like the decrease rate $\beta$ of the second conductivity, the conductivity measured by the electrical conductivity meter 486 gradually decreases (the decrease rate is small). On the other hand, when the leakage of the plating solution is absent, like the decrease rate $\alpha$ of the first conductivity, although the plating solution slightly remaining in the sealing member 494-2 or the flow passage of the cleaning liquid is detected by the electrical conductivity meter 486, after the plating solution is flowed to the downstream of the electrical conductivity meter 486, the conductivity rapidly decreases (the decrease rate is large). Therefore, when the difference between the decrease rate of the first conductivity and the decrease rate of the second conductivity becomes larger than the threshold set in advance, the determination member 480 can determine that the leakage of the plating solution to the arranged region of the contact member 494-4 is present. The plating module 400 can output an alarm to promote, for example, inspection, repair, and exchange of the leakage portion of the substrate holder 440.

According to this embodiment, since presence or absence of the leakage of the plating solution to the arranged region of the contact member 494-4 can be determined, when presence of leakage is determined, the substrate holder can be, for example, inspected, repaired, and exchanged. As a result, a variation of an electrical resistance due to corrosion of the contact member or deposition or adherence of a medicinal solution in the contact member can be reduced, and therefore homogenization of the plating process can be improved.

Figure 17:
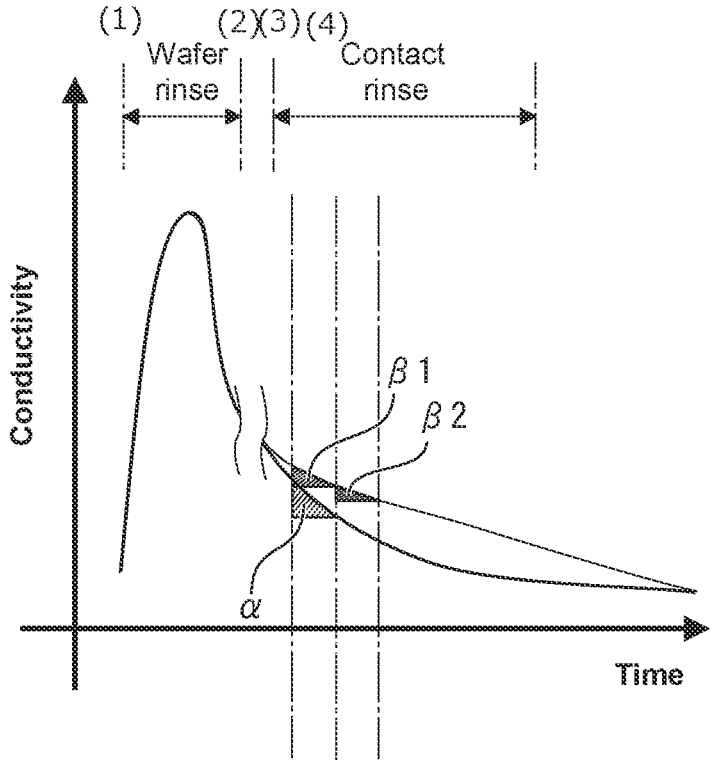
FIG. 17 is a drawing schematically illustrating a modification of leakage determination of a plating solution.

Note that while in the above-described embodiments, an example in which the decrease rate β of the second conductivity is obtained once and compared with the decrease rate α of the first conductivity has been described, the present invention is not limited to this. FIG. 17 is a drawing schematically illustrating a modification of leakage determination of the plating solution. As illustrated in FIG. 17, the determination member 480 obtains decrease rates of the second conductivities (for example, decrease rates β1, β2) in respective plurality of sections (for example, two sections), and compares the respective decrease rates β1, β2 to ensure determining presence or absence of leakage.

For example, when the decrease rates β1, β2 of the second conductivities in the two sections are substantially uniform (for example, when the difference between both is equal to or less than the predetermined threshold), the determination member 480 can determine that the leakage of the plating solution to the arranged region of the contact member 494-4 is present. That is, when the leakage of the plating solution to the arranged region of the contact member 494-4 is present, the measured conductivity tends to rectilinearly (line shape) decrease. On the other hand, when the leakage of that plating solution is absent, after the conductivity caused by the plating solution slightly attached to the sealing member 494-2 or the like rapidly decreases, the conductivity tends to gradually decrease. Accordingly, when the decrease rates β1, β2 of the conductivities are substantially equal, the determination member 480 can determine that the leakage is present. When the decrease rates β1, β2 of the conductivities are not substantially equal (for example, when the difference between both is larger than the predetermined threshold), the determination member 480 can determine that the leakage is absent.

Further, as another modification, for example, to shorten the time taken for the leakage determination, the determination member 480 can instantly determine that the leakage is present when the determination member 480 determines that the difference between the decrease rate α of the first conductivity and the decrease rate β1 of the second conductivity is larger than the threshold as in the above-described embodiment. In addition, when the difference between the decrease rate α and the decrease rate β1 is equal to or less than the threshold, the determination member 480 performs the above-described determination of the comparison between the decrease rates β1, β2 of the second conductivities to ensure enhancing the accuracy of leakage determination.

While several embodiments of the present invention have been described above in order to facilitate understanding of the present invention, the present invention is not limited to this. The present invention can be changed or improved without departing from the gist thereof, and obviously, the equivalents of the present invention are included in the present invention. It is possible to arbitrarily combine or omit respective constituent elements described in the claims and specification in a range in which at least a part of the above-described problems can be solved, or a range in which at least a part of the effects is exhibited.

As one embodiment, this application discloses a plating apparatus that includes a plating tank, a substrate holder, a contact cleaning member, a driving mechanism, and a nozzle cleaning cover. The plating tank is configured to house a plating solution. The substrate holder is configured to hold a substrate with a surface to be plated facing downward. The substrate holder includes a contact member for feeding power to the substrate. The contact cleaning member is for discharging a cleaning liquid to the contact member while the contact cleaning member is at a cleaning position between the plating tank and the substrate holder. The driving mechanism is configured to move the contact cleaning member between the cleaning position and a retracted position retracted from between the plating tank and the substrate holder. The nozzle cleaning cover is configured to cover an upper portion of the contact cleaning member while the contact cleaning member is at the retracted position.

As one embodiment, this application discloses the plating apparatus that further includes a tray member and a fixed tray member. The tray member is configured to house the contact cleaning member. The tray member is configured to receive the cleaning liquid that has dropped after being discharged from the contact cleaning member. The fixed tray member is arranged at the retracted position. The fixed tray member is configured to receive the cleaning liquid from the tray member. The cleaning liquid has dropped to the tray member. The driving mechanism is configured to move the tray member between the cleaning position and the retracted position. The nozzle cleaning cover is mounted to the fixed tray member.

As one embodiment, this application discloses the plating apparatus in which the nozzle cleaning cover includes a bottom plate tray, an upper plate, and a side plate. The bottom plate tray is mounted to the fixed tray member. The upper plate is arranged on an upper side of the bottom plate tray so as to be opposed to the bottom plate tray. The side plate couples the bottom plate tray and the upper plate.

As one embodiment, this application discloses the plating apparatus in which the upper plate has a receiving surface formed so as to be opposed to a discharge direction of the cleaning liquid of the contact cleaning member.

As one embodiment, this application discloses the plating apparatus in which the bottom plate tray has an inclined surface inclined so as to descend toward the fixed tray member.

As one embodiment, this application discloses a plating apparatus that further includes a coupling member configured to couple the fixed tray member and a drain tube. The coupling member includes a first flow passage, a second flow passage, and a third flow passage. The first flow passage extends from an opening formed in a bottom wall of the fixed tray member in a downward direction. The second flow passage extends from the drain tube in an upward direction. The third flow passage communicates between a bottom portion of the first flow passage and a top portion of the second flow passage. The bottom portion of the first flow passage is at a position lower than the top portion of the second flow passage.

As one embodiment, this application discloses a plating apparatus that further includes an electrical conductivity meter for measuring a conductivity of the cleaning liquid that has dropped to the tray member. The electrical conductivity meter is arranged on a bottom portion of the first flow passage.

REFERENCE SIGNS LIST

400 . . . plating module
410 . . . plating tank
440 . . . substrate holder
470 . . . cleaning device
472 . . . substrate cleaning member
472*a* . . . substrate cleaning nozzle
476 . . . driving mechanism
478 . . . tray member
480 . . . determination member
482 . . . contact cleaning member
482*a* . . . contact cleaning nozzle
484 . . . fixed tray member
484*a* . . . bottom wall
484*b* . . . opening
486 . . . electrical conductivity meter
486*a* . . . sensor
487 . . . coupling member
487*a* . . . first flow passage
487*b* . . . second flow passage
487*c* . . . third flow passage
488 . . . drain tube
489 . . . nozzle cleaning cover
489*a* . . . bottom plate tray
489*a*-1 . . . inclined surface
489*b* . . . upper plate
489*b*-1 . . . receiving surface
489*c* . . . side plate
494-2 . . . sealing member
494-4 . . . contact member
1000 . . . plating apparatus
Wf . . . substrate

The invention claimed is:

1. A plating apparatus comprising:

a plating tank configured to house a plating solution;

a substrate holder configured to hold a substrate with a surface to be plated facing downward, the substrate holder including a contact member for feeding power to the substrate;

a contact cleaning member for discharging a cleaning liquid to the contact member while the contact cleaning member is at a cleaning position between the plating tank and the substrate holder;

an arm configured to hold the contact cleaning member;

a driving mechanism configured to move the contact cleaning member between the cleaning position and a retracted position retracted from between the plating tank and the substrate holder by turning the arm;

a nozzle cleaning cover configured to cover an upper portion of the contact cleaning member while the contact cleaning member is at the retracted position, a tray member configured to house the whole of the contact cleaning member and the arm, the tray member being configured to receive the cleaning liquid that has dropped after being discharged from the contact cleaning member; and a fixed tray member arranged at the retracted position, the fixed tray member being configured to receive the cleaning liquid from the tray member, the cleaning liquid having dropped to the tray member, wherein the driving mechanism is configured to move the tray member between the cleaning position and the retracted position, and the nozzle cleaning cover is mounted to the fixed tray member.

2. The plating apparatus according to claim 1, wherein the nozzle cleaning cover includes a bottom plate tray, an upper plate, and a side plate, the bottom plate tray is mounted to the fixed tray member, the upper plate is arranged on an upper side of the bottom plate tray so as to be opposed to the bottom plate tray, and the side plate couples the bottom plate tray and the upper plate.

3. The plating apparatus according to claim 2, wherein the upper plate has a receiving surface formed so as to be opposed to a discharge direction of the cleaning liquid of the contact cleaning member.

4. The plating apparatus according to claim 2, wherein the bottom plate tray has an inclined surface inclined so as to descend toward the fixed tray member.

5. The plating apparatus according to claim 1, wherein the substrate holder includes a ring-shaped supporting member configured to support the outer peripheral portion of the surface to be plated of the substrate and has a center with an opening, the contact member is circularly attached to the supporting member, and the contact cleaning member is configured to discharge the cleaning liquid toward the contact member through the opening of the supporting member, the substrate holder includes a back plate assembly arranged on a back surface side of the surface to be plated of the substrate and configured to sandwich the substrate together with the supporting member, the back plate assembly is arranged at a position surrounded by the contact member when the contact member is cleaned, and the contact cleaning member is configured to discharge the cleaning liquid toward a lower surface of the back plate assembly and aim the cleaning liquid that has bounced after hitting against the lower surface of the back plate assembly toward the contact member.

6. A plating apparatus comprising:

a plating tank configured to house a plating solution;

a substrate holder configured to hold a substrate with a surface to be plated facing downward, the substrate holder including a contact member for feeding power to the substrate;

a contact cleaning member for discharging a cleaning liquid to the contact member while the contact cleaning member is at a cleaning position between the plating tank and the substrate holder;

a driving mechanism configured to move the contact cleaning member between the cleaning position and a retracted position retracted from between the plating tank and the substrate holder;

a nozzle cleaning cover configured to cover an upper portion of the contact cleaning member while the contact cleaning member is at the retracted position, a tray member configured to house the contact cleaning member, the tray member being configured to receive the cleaning liquid that has dropped after being discharged from the contact cleaning member; and a fixed tray member arranged at the retracted position, the fixed tray member being configured to receive the cleaning liquid from the tray member, the cleaning liquid having dropped to the tray member, wherein the driving mechanism is configured to move the tray member between the cleaning position and the retracted position, and the nozzle cleaning cover is mounted to the fixed tray member, wherein the plating apparatus further comprises:

a coupling member configured to couple the fixed tray member and a drain tube, wherein the coupling member includes a first flow passage, a second flow passage, and a third flow passage, the first flow passage extends from an opening formed in a bottom wall of the fixed tray member in a downward direction, the second flow passage extends from the drain tube in an upward direction, the third flow passage communicates between a bottom portion of the first flow passage and a top portion of the second flow passage, and the bottom portion of the first flow passage is at a position lower than the top portion of the second flow passage.

7. The plating apparatus according to claim 6, further comprising an electrical conductivity meter for measuring a conductivity of the cleaning liquid that has dropped to the tray member, wherein the electrical conductivity meter is arranged on a bottom portion of the first flow passage.

8. The plating apparatus according to claim 6, wherein the substrate holder includes a ring-shaped supporting member configured to support the outer peripheral portion of the surface to be plated of the substrate and has a center with an opening, the contact member is circularly attached to the supporting member, and the contact cleaning member is configured to discharge the cleaning liquid toward the contact member through the opening of the supporting member, the substrate holder includes a back plate assembly arranged on a back surface side of the surface to be plated of the substrate and configured to sandwich the substrate together with the supporting member, the back plate assembly is arranged at a position surrounded by the contact member when the contact member is cleaned, and the contact cleaning member is configured to discharge the cleaning liquid toward a lower surface of the back plate assembly and aim the cleaning liquid that has bounced after hitting against the lower surface of the back plate assembly toward the contact member.

* * * * *